US008364050B2

(12) United States Patent
Yasukawa

(10) Patent No.: US 8,364,050 B2
(45) Date of Patent: Jan. 29, 2013

(54) PRINTING SYSTEM, METHOD FOR CONTROLLING THE PRINTING SYSTEM, AND STORAGE MEDIUM

(75) Inventor: Takuma Yasukawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 814 days.

(21) Appl. No.: 12/271,729

(22) Filed: Nov. 14, 2008

(65) Prior Publication Data

US 2009/0129802 A1 May 21, 2009

(30) Foreign Application Priority Data

Nov. 15, 2007 (JP) ..... 2007-296848

(51) Int. Cl.
*G03G 15/00* (2006.01)

(52) U.S. Cl. ..... 399/38; 399/43; 399/18

(58) Field of Classification Search ..... None
See application file for complete search history.

(56) References Cited

U.S. PATENT DOCUMENTS

| | | | | |
|---|---|---|---|---|
| 6,219,502 | B1 * | 4/2001 | Osari et al. | 399/82 |
| 2002/0110380 | A1 * | 8/2002 | McIntyre | 399/15 |
| 2005/0191068 | A1 * | 9/2005 | Sato | 399/38 |

FOREIGN PATENT DOCUMENTS

| | | | |
|---|---|---|---|
| JP | 2004-142250 | A | 5/2004 |
| JP | 2006-023475 | A | 1/2006 |
| JP | 2006-163052 | A | 6/2006 |

* cited by examiner

*Primary Examiner* — Walter L Lindsay, Jr.
*Assistant Examiner* — Roy Y Yi
(74) *Attorney, Agent, or Firm* — Canon USA, Inc., IP Division

(57) ABSTRACT

A method for controlling a printing system adapted to perform an adjustment operation with an adjusting unit includes storing information indicating a timing for performing the adjustment operation in a storage unit, causing the adjusting unit to perform the adjustment operation based on the information indicating the timing for performing the adjustment operation stored in the storage unit, causing the adjusting unit to perform the adjustment operation at a timing different from the timing indicated by the information in response to a print interruption occurring in the printing system if a previous adjustment operation has not been performed within a predetermined period of time, and updating the information indicating the timing for performing the adjustment operation stored in the storage unit in response to the adjusting unit performing the adjustment operation to delay a timing for performing a next adjustment operation with the adjusting unit.

25 Claims, 21 Drawing Sheets

FIG.12

| | ADJUSTMENT OPERATION THAT CAN BE PERFORMED IF PRINT INTERRUPTION FACTOR HAS OCCURRED | | | |
|---|---|---|---|---|
| PRINT INTERRUPTION FACTOR | DENSITY ADJUSTMENT | GRADATION CORRECTION | GLUE TEMPERATURE ADJUSTMENT | PAPER FEED UNIT |
| CASSETTE-OPEN | × | × | × | × |
| NO PAPER | ○ | ○ | ○ | × |
| FULL-STACK ON TRAY | × | ○ | ○ | ○ |
| . . . | | | | |

FIG.13

| | INFORMATION ABOUT ADJUSTMENT OPERATION | | | |
|---|---|---|---|---|
| ADJUSTMENT OPERATION | TIME OF LAST PERFORMANCE | TIME FOR PERFORMING NEXT PERIODICAL OPERATION | NUMBER OF REMAINING PRINTS BEFORE ADJUSTMENT OPERATION (COPIES) | ESTIMATED TIME REQUIRED (SECONDS) |
| DENSITY ADJUSTMENT | 15:05 | 15:20 | 500 | 60 |
| GRADATION CORRECTION | 15:15 | 15:35 | 600 | 10 |
| GLUE TEMPERATURE ADJUSTMENT | 14:40 | 15:25 | — | 120 |
| PAPER FEED UNIT | 15:10 | 15:30 | 400 | 20 |
| . . . | | | | |

FIG.18

| | INFORMATION ABOUT ADJUSTMENT OPERATION | | | | | |
|---|---|---|---|---|---|---|
| ADJUSTMENT OPERATION | TIME OF LAST PERFORMANCE | TIME FOR PERFORMING NEXT PERIODICAL OPERATION | NUMBER OF REMAINING PRINTS BEFORE ADJUSTMENT OPERATION (COPIES) | SHORTEST TIME INTERVAL FOR PERFORMING OPERATION (MINUTES) | ESTIMATED TIME REQUIRED (SECONDS) | PRIORITY LEVEL |
| DENSITY ADJUSTMENT | 15:05 | 15:20 | 500 | 10 | 60 | 1 |
| GRADATION CORRECTION | 15:15 | 15:35 | 600 | 15 | 10 | 2 |
| GLUE TEMPERATURE ADJUSTMENT | 14:40 | 15:25 | — | 10 | 120 | 3 |
| PAPER FEED UNIT | 15:10 | 15:30 | 400 | 15 | 20 | 4 |
| . . . | | | | | | |

FIG.21

| DIRECTORY INFORMATION |
| --- |
| PROGRAM CODE CORRESPONDING TO STEPS IN FLOW CHART OF FIG. 14 |
| PROGRAM CODE CORRESPONDING TO STEPS IN FLOW CHART OF FIG. 17 |
| |

PRINTING SYSTEM, METHOD FOR CONTROLLING THE PRINTING SYSTEM, AND STORAGE MEDIUM

BACKGROUND OF THE INVENTION

1. Field of the Invention

The present invention relates to a printing system, a method for controlling the printing system, and a storage medium.

2. Description of the Related Art

A conventional printing system can periodically perform an adjustment operation, such as a gradation correction operation or a toner density adjustment operation, to obtain an appropriate print product. In such a printing system, it is necessary to suspend currently-operated print processing during an adjustment operation (see Japanese Patent Application Laid-Open No. 2006-163052).

Furthermore, in a conventional printing system, a print job that is currently performed is interrupted due to the shortage of a resource that is necessary to perform a print job. In addition, in such a conventional printing system, if a print job is interrupted due to the shortage of the resource, the interrupted print job is not resumed until the resource is replenished by the user. In this case, the print job is resumed only after it is detected that the resource has been replenished.

However, in the conventional printing system, for example, even if a print interruption factor due to the shortage of the resource has been solved, an adjustment operation is automatically performed at a timing the print interruption factor is solved. In this case, the resumed print job may be interrupted again. Thus, according to the conventional printing system described above, a print job may be frequently interrupted. In this case, the productivity of the printing system may degrade.

SUMMARY OF THE INVENTION

The present invention is directed to a printing system capable of preventing the productivity of the printing system from degrading by reducing the frequency of occurrence of cases where a print job is interrupted.

According to an aspect of the present invention, a printing system adapted to perform an adjustment operation with an adjusting unit includes a storage unit configured to store information indicating a timing for performing the adjustment operation, and a control unit configured to cause the adjusting unit to perform the adjustment operation based on the information indicating the timing for performing the adjustment operation stored in the storage unit. The control unit is configured to cause the adjusting unit to perform the adjustment operation at a timing different from the timing indicated by the information in response to a print interruption occurring in the printing system if a previous adjustment operation has not been performed within a predetermined period of time. The control unit is further configured to update the information indicating the timing for performing the adjustment operation stored in the storage unit in response to the adjusting unit performing the adjustment operation to delay a timing for performing a next adjustment operation with the adjusting unit.

Further features and aspects of the present invention will become apparent from the following detailed description of embodiments with reference to the attached drawings.

BRIEF DESCRIPTION OF THE DRAWINGS

The accompanying drawings, which are incorporated in and constitute a part of the specification, illustrate embodiments, features, and aspects of the invention and, together with the description, serve to describe the principles of the present invention.

FIG. 12 illustrates an example of a correspondence table according to an embodiment of the present invention.

FIG. 13 illustrates an example of an information table according to an embodiment of the present invention.

FIG. 18 illustrates an example of an information table according to an embodiment of the present invention.

FIG. 21 illustrates an example of program code according to an embodiment of the present invention.

DETAILED DESCRIPTION OF THE EMBODIMENTS

Various embodiments, features, and aspects of the present invention will now be herein described in detail below with reference to the drawings. It is to be noted that the relative arrangement of the components, the numerical expressions, and numerical values set forth in these embodiments are not intended to limit the scope of the present invention.

First Embodiment

Figure 1:
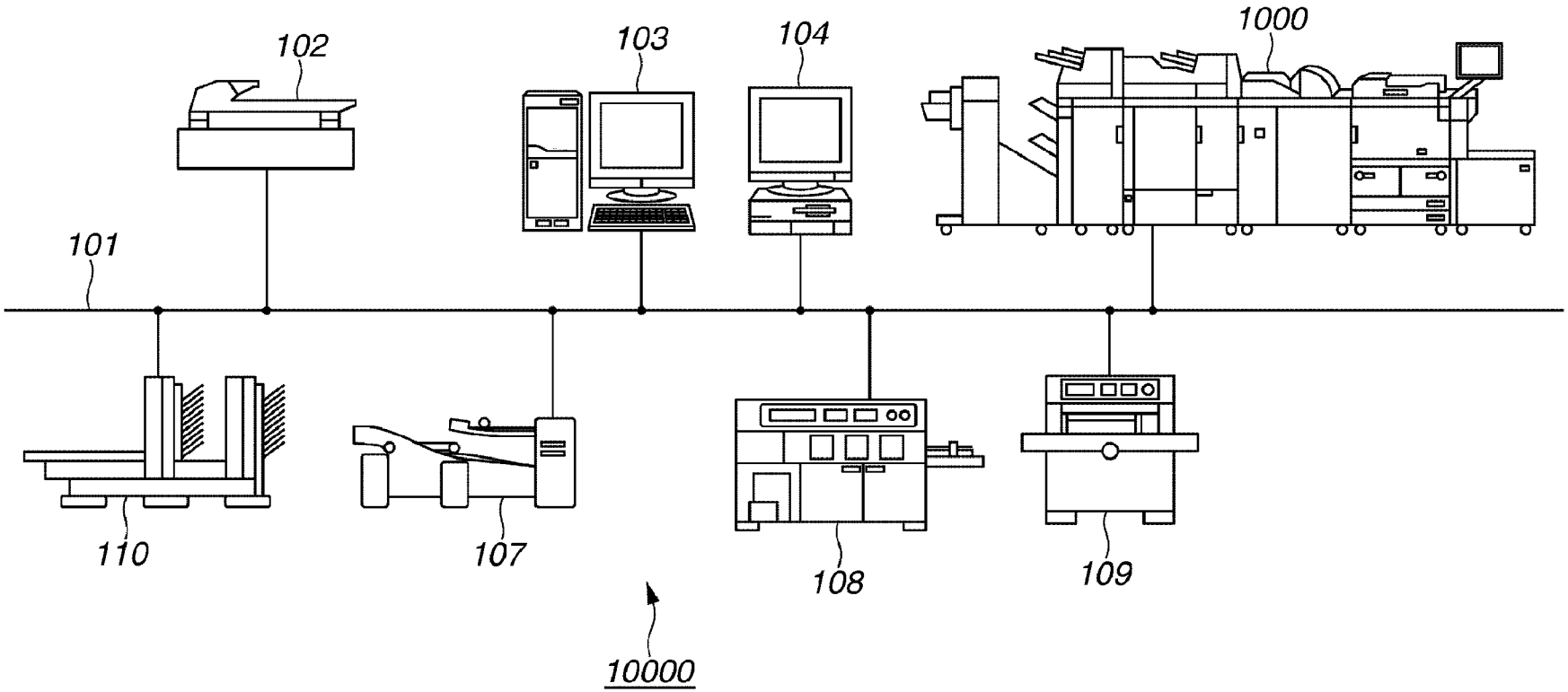
FIG. 1 illustrates an example of a configuration of the entire print on demand (POD) system that includes aprinting system according to an embodiment of the present invention.

A first embodiment of the present invention will now be described below. FIG. 1 illustrates an example of a configuration of the entire POD system that includes a printing system according to the first embodiment of the present invention. Referring to FIG. 1, a POD system 10000 includes a printing system 1000, a scanner 102, a server computer 103 (a PC 103), and a client computer 104 (a PC 104). The printing system 1000, the scanner 102, a server computer 103 (the PC 103), and the client computer 104 (the PC 104) are in communication with one another via a network 101. Furthermore, the POD system 10000 includes a paper folding machine 107, a cutting machine 109, a saddle stitch binding machine 110, and a case binding machine 108.

Figure 2:
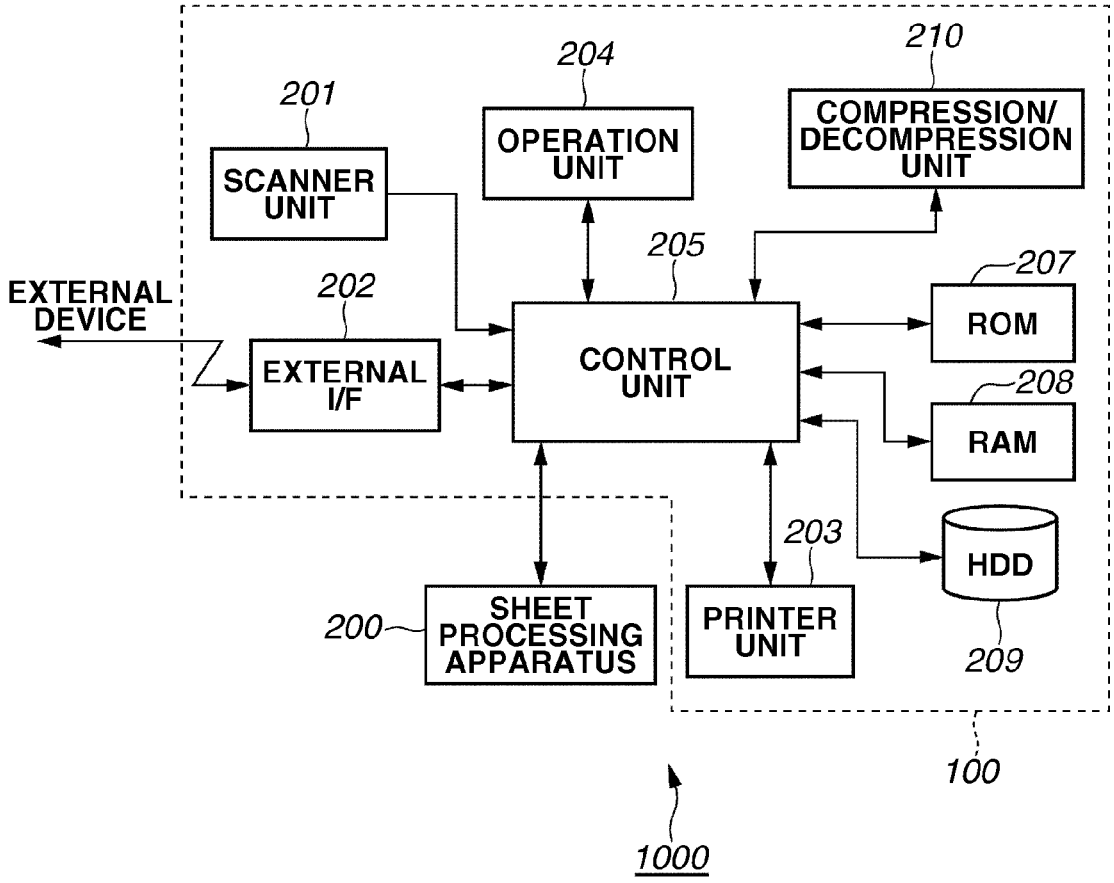
FIG. 2 illustrates an example of a configuration of the printing system according to an embodiment of the present invention.

The printing system 1000, which is an example of a job processing apparatus, includes a plurality of types of apparatuses, such as a printing apparatus 100 (FIG. 2) and a sheet processing apparatus 200 (FIG. 2). Note that in the present embodiment, a multifunction peripheral (MFP) having a plurality of functions, such as a copy function and a printer function, is described as an example of the printing apparatus 100. However, the present embodiment is not limited to this. That is, a printing apparatus that has a single function only, such as a copy function or a printer function, can be used as the printing apparatus 100.

The PC 103 manages a data communication performed among various apparatuses connected to the network 101. The PC 104 sends image data to the printing apparatus 100 and the PC 103 via the network 101.

In addition, the paper folding machine 107 performs processing for folding sheets that have been printed by the printing apparatus 100. The case binding machine 108 performs processing for case-binding sheets that have been printed by the printing apparatus 100.

The cutting machine 109 performs processing for cutting sheets that have been printed by the printing apparatus 100 with respect to a sheet stack including a plurality of sheets that has been printed by the printing apparatus 100. The saddle stitch binding machine 110 performs processing for saddle-stitch binding sheets that have been printed by the printing apparatus 100.

In utilizing the paper folding machine 107, the case binding machine 108, the cutting machine 109, or the saddle stitch binding machine 110, the user takes out the sheets that have been printed by the printing apparatus 100 from the printing system 1000, sets the sheets on the apparatus that the user desires to utilize (in this case, either the paper folding machine 107, the case binding machine 108, the cutting machine 109, or the saddle stitch binding machine 110) to perform the desired processing on the apparatus set by the user to be used. Furthermore, among the plurality of apparatuses included in the POD system 10000 illustrated in FIG. 1, the apparatuses except the saddle stitch binding machine 110 are connected to the network 101. Thus, the apparatuses other than the saddle stitch binding machine 110 can perform data communications among them.

An exemplary configuration of the printing system 1000 is described below with reference to a system block diagram illustrated in FIG. 2. Components of the printing system 1000 except a sheet processing apparatus 200 illustrated in FIG. 2 are included in the printing apparatus 100.

Referring to FIG. 2, an arbitrary number of sheet processing apparatuses 200 can be connected to the printing apparatus 100. The printing system 1000 can perform sheet processing on the sheets that have been printed by the printing apparatus 100 with the sheet processing apparatus 200 connected to the printing apparatus 100.

The sheet processing apparatus 200 can communicate with the printing apparatus 100 and receive an instruction from the printing apparatus 100 to perform the sheet processing, which will be described in detail below. Note that the sheet processing apparatus 200 is also referred to as a "post-processing apparatus" in the present embodiment. Similarly, the sheet processing performed by the sheet processing apparatus 200 is also referred to as "post-processing".

The scanner unit 201 reads an image of an original document, converts the read image into image data, and transfers the converted image to other units.

An external interface (I/F) unit 202 sends and receives data to and from other apparatuses connected to the network 101.

A printer unit 203 prints an image based on the image data input by scanning with the scanner unit 201 on a sheet.

Figure 7:
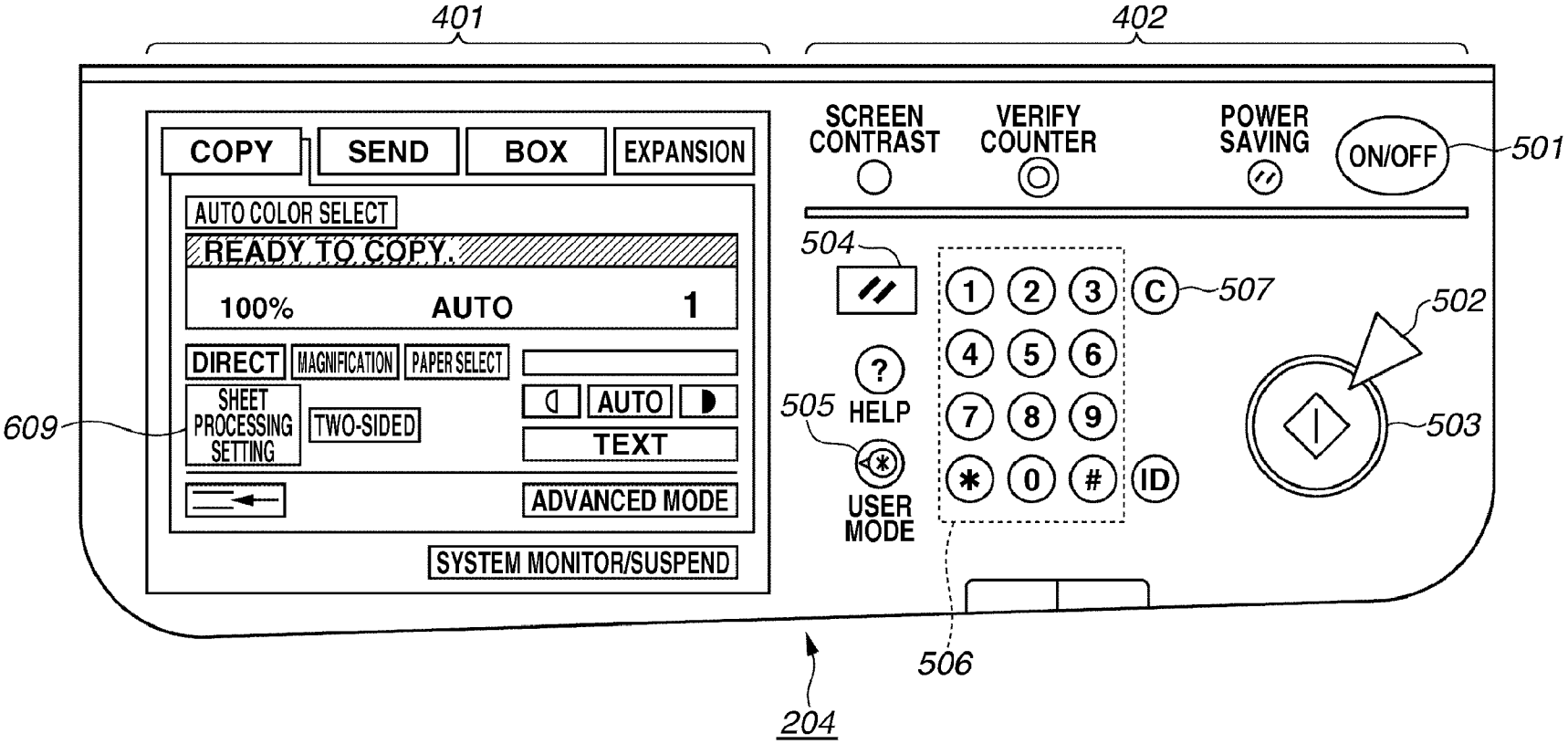
FIG. 7 illustrates an example of an operation unit according to an embodiment of the present invention.

An operation unit 204 includes a hard key input unit 402 (FIG. 7) and a touch panel 401 (FIG. 7). The operation unit 204 receives an instruction from the user operating the hard key input unit 402 and the touch panel 401. In addition, the operation unit 204 displays various types of information on the touch panel 401.

A control unit 205 controls the entire printing system 1000 by controlling the operations of each unit of the printing system 1000. Furthermore, the control unit 205 controls the operations of the printing apparatus 100 and the sheet processing apparatus 200 connected to the printing apparatus 100.

A read-only memory (ROM) 207 stores various programs to be executed by the control unit 205. More specifically, the ROM 207 stores, for example, a program for performing various processing illustrated in the flow charts, and a display control program for displaying various setting screens, which will be described in detail below.

In addition, the ROM 207 stores a program for performing an operation by the control unit 205 for interpreting page description language (PDL) code data received from the PC 103 or the PC 104 and rasterizing the PDL code data into raster image data. In addition, the ROM 207 stores various programs such as a system boot sequence and font information.

A random access memory (RAM) 208 stores image data sent from the scanner unit 201 or the external I/F 202. In addition, the RAM 208 stores various programs and setting information loaded and sent from the ROM 207. In addition, the RAM 208 stores various types of information about the sheet processing apparatus 200, such as the number (the number is an integer from 0 to n) of the sheet processing apparatuses 200 that are connected to the printing apparatus 100, information about a function of the sheet processing apparatus 200, and an order of connecting the plurality of the sheet processing apparatuses 200 to the printing apparatus 100, for example.

A hard disk drive (HDD) 209 includes components such as a hard disk and a driving unit for reading and writing data from and on the hard disk. The HDD 209 is a mass storage device that stores image data that has been input via the scanner unit 201 or the external I/F unit 202 and compressed by a compression/decompression unit 210.

The control unit 205 can print the image data stored on the HDD 209 with the printer unit 203 according to an instruction from the user. Furthermore, the control unit 205 can send the image data stored on the HDD 209 to an external apparatus, such as the PC 103, via the external I/F unit 202 according to an instruction from the user.

The compression/decompression unit 210 performs compression and decompression processing on image data stored in the RAM 208 and the HDD 209 based on various compression formats, such as Joint Bi-level Image Experts Group (JBIG) or Joint Photographic Experts Group (JPEG).

Figure 3:
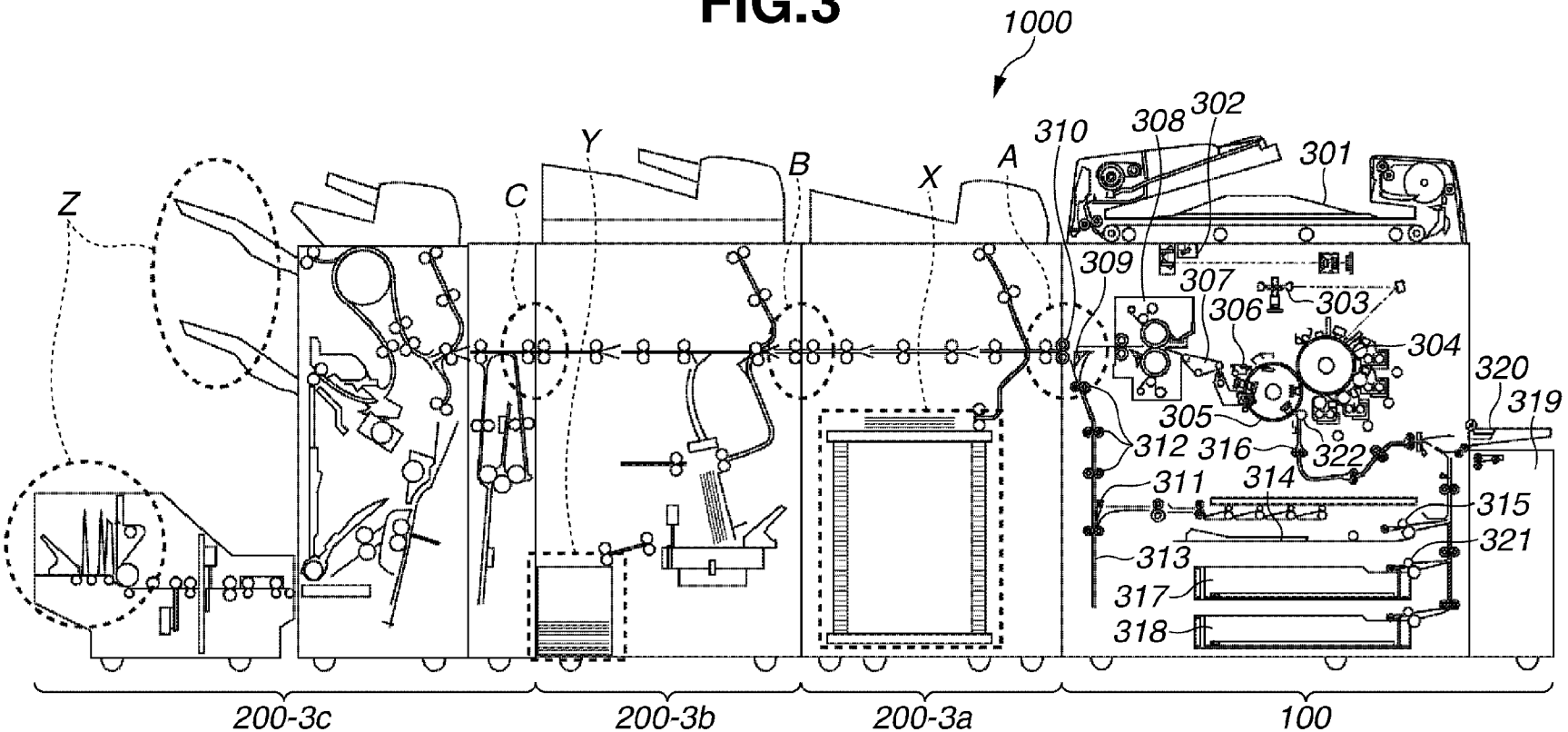
FIG. 3 illustrates an example of a configuration of the printing system according to an embodiment of the present invention.

An exemplary configuration of the printing system 1000 is described below with reference to FIG. 3. FIG. 3 is a cross section that illustrates an example of the printing apparatus 100 and the sheet processing apparatus 200, which is connected to the printing apparatus 100, according to the present embodiment.

Referring to FIG. 3, an auto document conveyance apparatus (auto document feeder (ADF)) 301 separates a document bundle set on a stacking surface of a document tray page by page from the first page. Then, the ADF 301 feeds the document onto a document mounting glass to scan the document with a scanner 302.

The scanner 302 reads an image on the document that has been conveyed onto the document mounting glass and converts the read document image into image data with an image sensor, such as a charge-coupled device (CCD).

A ray, such as a laser beam, which has been modulated according to the image data, is made incident on a rotating polygonal mirror 303. The ray reflected from the rotating polygonal mirror 303 then falls on the surface of a photosensitive drum 304 via a reflection mirror as reflection scanning light to form a latent image on the surface of the photosensitive drum 304.

The latent image formed on the surface of the photosensitive drum 304 with the ray is then developed with toner. The toner image thus formed is transferred onto the sheet conveyed and attached onto the surface of a transfer drum 305.

By serially performing a series of image forming processing on toners of colors of yellow (Y), magenta (M), cyan (C), and black (K), a full color image is formed. After performing four-image forming processing, a sheet on the transfer drum 305, onto which a full color image has been formed, is then separated from the transfer drum 305 by a separation claw 306. Then, the separated sheet is conveyed to a fixing device 308 by a pre-fixing conveyance unit 307.

The fixing device 308 includes rollers and a belt in combination with one another. Furthermore, the fixing device 308 includes therein a heat source such as a halogen heater. The fixing device 308 applies heat and pressure to the toner on the sheet having the transferred toner image. Thus, the toner on the sheet having the toner image is fused and fixed.

A sheet discharge flapper 309 can swing around an axis. The sheet discharge flapper 309 swings to regulate a direction of conveying a sheet. When the sheet discharge flapper 309 swings clockwise in FIG. 3, the sheet is conveyed in a straight direction. Then, the sheet is conveyed to a paper discharge roller 310 and is then discharged out of the printing apparatus 100 by the paper discharge roller 310.

With a series of processing described above, the control unit 205 controls the printing apparatus 100 so that the printing apparatus 100 performs one-sided printing.

On the other hand, in the case of forming images on both sides of the sheet (two-sided printing), the sheet discharge flapper 309 swings counterclockwise in FIG. 3 to change the path for conveying the sheet to a downward direction. Thus, the sheet is conveyed to a two-sided conveyance unit. The two-sided conveyance unit includes a reversal flapper 311, a reversal roller 312, a reversal guide 313, and a two-sided tray 314.

The reversal flapper 311 swings around an axis and regulates the direction of conveying the sheet. In the case of performing a two-sided print job, the control unit 205 performs the following control. That is, the control unit 205 performs control so that the reversal flapper 311 swings counterclockwise in FIG. 3 to convey the sheet, whose first surface has been already printed with the printer unit 203, into the reversal guide 313 via the reversal roller 312.

Then, the control unit 205 temporarily stops the reversal roller 312 in the state where a trailing edge of the sheet is pinched by the reversal roller 312. Then, the control unit 205 allows the reversal flapper 311 to swing counterclockwise in FIG. 3. Furthermore, the control unit 205 allows the reversal roller 312 to rotate in a reverse direction.

As described above, the control unit 205 performs control so that the sheet is switched back to be conveyed. The control unit 205 performs control to guide the sheet to the two-sided tray 314 in the state where the leading edge and trailing edge of the sheet have been changed in position.

The two-sided tray 314 temporarily stacks the sheet that has been conveyed thereto as described above. Then, the sheet temporarily stacked on the two-sided tray 314 is conveyed into the printing apparatus 100 again to a registration roller 316 by a paper refeed roller 315. At this time, the sheet is fed with a surface thereof opposite to the first surface used in the transfer processing facing the photosensitive drum 304.

Then, the control unit 205 performs control to form an image on the second surface of the sheet as in the processing described above.

Thus, images are formed on both sides of the sheet. Then, the sheet having the image formed thereon is subjected to fixing processing. After that, the sheet having the image fixed thereon is conveyed to the paper discharge roller 310 again and discharged to the outside of the printing apparatus 100 via the paper discharge roller 310. By serially performing the processing described above, the control unit 205 controls the printing apparatus 100 to perform two-sided printing.

In addition, the printing apparatus 100 includes a paper feed unit that stacks sheets to be used in the print processing. As the paper feed unit, paper cassettes 317 and 318, a paper feed deck 319, and a manual feed tray 320 are used in the present embodiment. Each of the paper cassettes 317 and 318 can stack five hundred sheets, for example, while the paper feed deck 319 can stack five thousand sheets, for example.

Here, various types of sheets of different sizes and materials can be respectively set in each paper feed unit on the paper cassettes 317 and 318 and the paper feed deck 319. Furthermore, in the manual feed tray 320, various types of sheets including a special sheet, such as an overhead projector (OHP) sheet, can be set.

Each of the paper feed cassettes 317 and 318, the paper feed deck 319, and the manual feed tray 320 includes a paper feed roller. The sheets stacked on the paper feed unit are serially fed by the paper feed roller sheet by sheet.

Now, the sheet processing apparatus 200 connected to the printing apparatus 100 illustrated in FIG. 3 will be described below.

An arbitrary number of different types of sheet processing apparatuses 200 in the printing system 1000 according to the present embodiment can be connected in tandem as long as sheets can be conveyed from the sheet processing apparatus 200 on the upstream side to the sheet processing apparatus 200 on the downstream side via a sheet conveyance path. In this regard, for example, the sheet processing apparatuses 200 can be connected to the printing apparatus 100 in order of a large-capacity stacker 200-3*a*, a gluing binding machine 200-3*b*, and a saddle stitch binding machine 200-3*c*, in order of increasing distance from the printing apparatus 100, as illustrated in FIG. 3. The large-capacity stacker 200-3*a*, the gluing binding machine 200-3*b*, and the saddle stitch binding machine 200-3*c* can be selectively used by the printing system 1000.

Furthermore, each of the sheet processing apparatus 200 includes a sheet discharge unit. The user can take out the sheet that has been already subjected to the above-described sheet processing from the sheet discharge unit of each of the sheet processing apparatuses 200.

The control unit 205 performs the following processing for controlling the sheet processing apparatus 200 connected to the printing apparatus 100 according to an instruction from the user.

For example, in the case where the user has operated the operation unit 204 and thus issued an instruction for performing processing for stacking a large number of sheets to perform a print job, the control unit 205 performs the processing for printing the sheet for the instructed print job with the printing apparatus 100. Then, the control unit 205 stacks a large amount of printed sheets in the large-capacity stacker 200-3*a* connected to the printing apparatus 100.

On the other hand, in the case where the user has operated the operation unit 204 and thus issued an instruction for performing case binding processing, the control unit 205 performs processing for printing on the sheet for the print job with the printing apparatus 100. Then, the control unit 205 performs the case binding processing on the printed sheets with the gluing binding machine 200-3*b* connected to the printing apparatus 100.

On the other hand, in the case where the user has operated the operation unit 204 and issued an instruction for performing pad binding processing, the control unit 205 performs the processing for printing on the sheet for the print job with the printing apparatus 100. Then, the control unit 205 performs the pad binding processing instructed by the user on the printed sheets with the gluing binding machine 200-3*b* connected to the printing apparatus 100.

Furthermore, in the case where the user has operated the operation unit 204 and issued an instruction for performing saddle stitch binding processing, the control unit 205 performs the processing for printing on the sheet for the print job with the printing apparatus 100. Then, the control unit 205 performs stapling processing instructed by the user on the printed sheets with the saddle stitch binding machine 200-3*c* connected to the printing apparatus 100.

Similarly, in the case where the user has operated the operation unit 204 and issued an instruction for performing either of punching processing, cutting processing, and folding processing, the control unit 205 performs the sheet processing instructed by the user with the saddle stitch binding machine 200-3*c* connected to the printing apparatus 100.

The control unit 205 receives a request for performing sheet processing desired by the user, of candidates for sheet processing that can be performed with the sheet processing apparatus 200 connected to the printing apparatus 100, together with a print request issued by the user via the operation unit 204.

When the control unit 205 receives the request for printing the job to be subjected to the instructed sheet processing via the operation unit 204, the control unit 205 performs the print processing required in the print job on the sheet with the printer unit 203.

Then, the control unit 205 performs control for conveying the sheet that has been printed in the print job to the sheet processing apparatus 200 that can perform the sheet processing desired by the user via the sheet conveyance path, to perform the requested sheet processing with the sheet processing apparatus 200.

Here, suppose, in the printing system 1000 having the configuration illustrated in FIG. 3, that the user has instructed the control unit 205 via the operation unit 204 to perform processing for stacking a large amount of sheets with the large-capacity stacker 200-3*a* with respect to the print job to be subjected to the sheet processing desired by the user (in this case, the processing for stacking a large amount of sheets) whose request for printing has been issued by the user. The job like this is hereinafter simply referred to as a "stacker job".

In the case where the stacker job is processed in the system having the configuration illustrated in FIG. 3, the control unit 205, at first, allows the sheet in the job that has been printed with the printing apparatus 100 to pass a point A in FIG. 3 and to be conveyed into the large-capacity stacker 200-3*a*. After that, the control unit 205 performs the stacking processing in the job with the large-capacity stacker 200-3*a*.

Then, the control unit 205 allows the print product of the job on which the stacking processing has been performed with the large-capacity stacker 200-3*a* to be held in a paper discharge destination X in the large-capacity stacker 200-3*a*, without conveying the print product to another apparatus (for example, an apparatus downstream to the large-capacity stacker 200-3*a*).

The user can take out the print product of the stacker job that is held in the paper discharge destination X in FIG. 3 directly from the paper discharge destination X. Accordingly, a series of operations of the apparatuses and the user's operation including conveyance of the sheet to a paper discharge destination Z at the most downstream position in the sheet conveyance direction in FIG. 3 and taking out of the print product of the stacker job from the paper discharge destination Z become unnecessary.

In addition, suppose that the job to be processed whose request for printing has been received from the user in the system configuration in FIG. 3 is a job that has been instructed to be subjected to sheet processing (for example, gluing binding processing, such as case binding processing or top gluing binding) with the gluing binding machine 200-3*b*. That job is herein referred to as a "gluing binding job".

In the case of performing the gluing binding job in the system having the configuration illustrated in FIG. 3, the control unit 205, at first, allows a sheet printed with the printing apparatus 100 to be conveyed into the inside of the gluing binding machine 200-3*b* via points A and B in FIG. 3. After that, the control unit 205 performs the gluing binding processing of the job with the gluing binding machine 200-3*b*.

After the gluing binding processing for the job with the gluing binding machine 200-3*b* is completed, the control unit 205 allows the print product of the job on which the gluing binding processing has been performed with the gluing binding machine 200-3*b* to be held in a paper discharge destination Y in the gluing binding machine 200-3*b*, without conveying the print product to another apparatus (for example, an apparatus downstream to the gluing binding machine 200-3*b*).

Furthermore, for example, suppose, in the printing system 1000 having the configuration illustrated in FIG. 3, that a job to be processed whose request for printing has been received from the user is a job that has been instructed to be subjected to sheet processing with the saddle stitch binding machine 200-3*c*.

Here, the sheet processing performed with the saddle stitch binding machine 200-3*c* includes, for example, the saddle stitch binding processing, the punching processing, the cutting processing, shift discharge processing, and the folding processing. The job like this is hereinafter collectively and simply referred to as a "saddle stitch binding job".

In the case of processing the saddle stitch binding job with the system configuration in FIG. 3, the control unit 205 allows a sheet used in the job printed with the printing apparatus 100 to pass points A, B, and C in FIG. 3 to be conveyed to the saddle stitch binding machine 200-3*c*. After that, the control unit 205 performs the sheet processing of the job with the saddle stitch binding machine 200-3*c*.

After the saddle stitch binding processing for the job with the saddle stitch binding machine 200-3*c* is completed, the control unit 205 allows the print product of the saddle stitch binding job that has been subjected to the sheet processing with the saddle stitch binding machine 200-3*c* to be held in the paper discharge destination Z in the saddle stitch binding machine 200-3*c*.

Note that in the present embodiment, the paper discharge destination Z includes a plurality of paper discharge destination options. With the plurality of paper discharge destination options, the saddle stitch binding machine 200-3*c* can perform a plurality of types of sheet processing in which different discharge destinations are used for respective types of sheet processing.

As described above with reference to FIGS. 1 through 3, in the printing system 1000 according to the present embodiment, a plurality of sheet processing apparatuses 200 can be connected to the printing apparatus 100. The plurality of sheet processing apparatuses 200 can be connected to the printing apparatus 100 in an arbitrary combination thereof.

Furthermore, the order of connection of the plurality of sheet processing apparatuses 200 to the printing apparatus 100 can be freely determined or changed as long as the sheet conveyance paths provided among the sheet processing apparatuses 200 can be continuously provided. Furthermore, a plurality of different types of sheet processing apparatuses 200 can be used as the sheet processing apparatuses that can be connected to the printing apparatus 100.

Now, an exemplary inner configuration of the sheet processing apparatus 200 that can be connected to the printing apparatus 100 according to the present embodiment is described with reference to FIGS. 4 through 6.

To begin with, an exemplary inner configuration of the large-capacity stacker 200-3*a* (FIG. 3) is described with reference to the cross section in FIG. 4.

Figure 4:
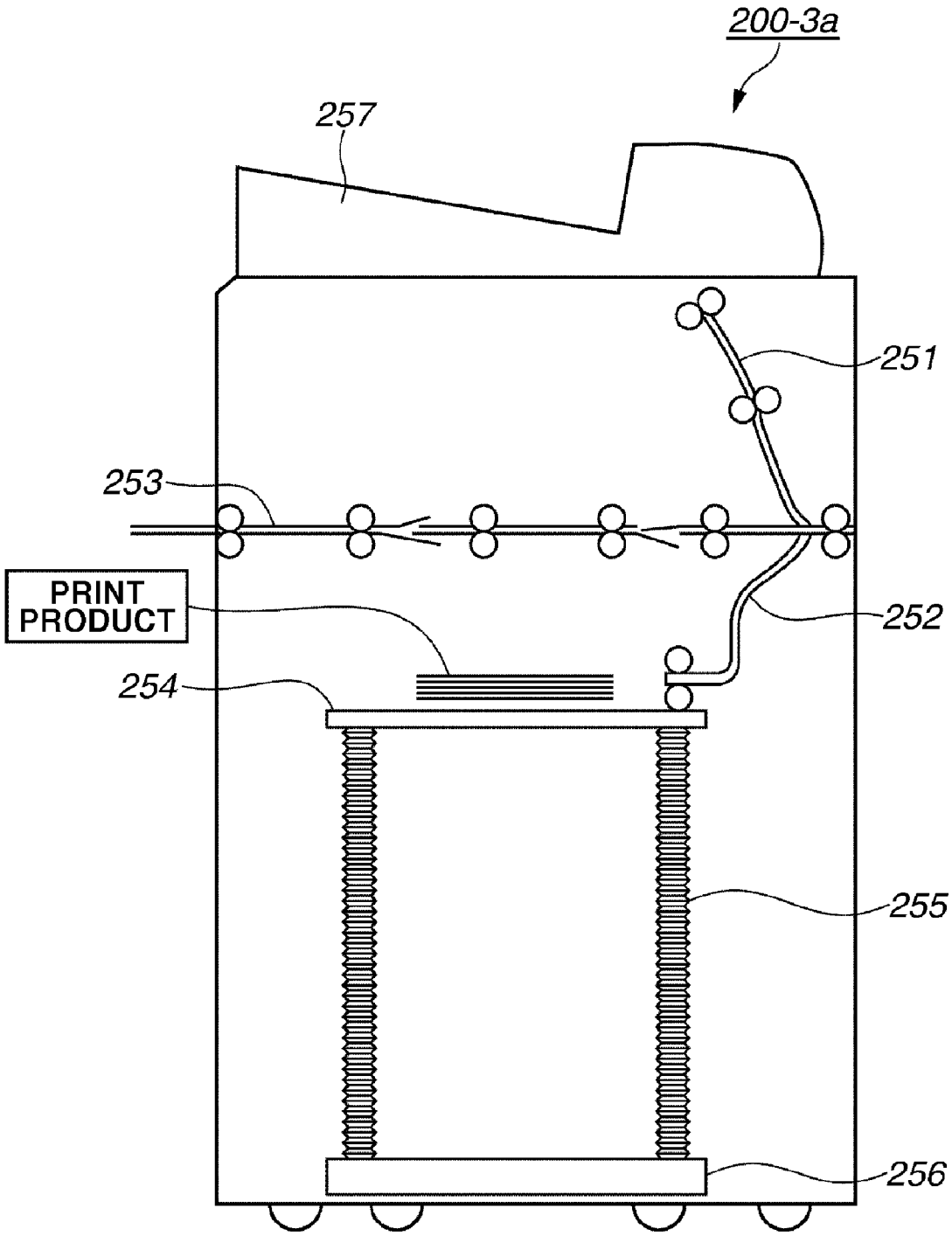
FIG. 4 illustrates an example of an inner configuration of an inline finisher according to an embodiment of the present invention.

Referring to FIG. 4, the large-capacity stacker 200-3*a* conveys the sheet that has been conveyed from an upstream apparatus selectively into three conveyance paths. The three conveyance paths include a sample tray path 251, a stack path 252, and a straight path 253.

The stack path 252, which is included in the large-capacity stacker 200-3*a*, is a sheet conveyance path for conveying the sheet onto a stack tray 254.

The stack tray 254 is a stacking unit that is provided above an extendable stay 255. A detachable cart 256 is provided below the extendable stay 255. An operator (or the user) can easily carry the sheet that has been stacked on the stack tray 254 by using the detachable cart 256.

Here, in the case where the user has operated the operation unit 204 to issue a request for performing a job for starting processing for stacking the sheet with the large-capacity stacker 200-3*a*, the control unit 205 performs control for conveying the sheet that has been printed with the printing apparatus 100 into the stack path 252 of the large-capacity stacker 200-3*a* and discharging the sheet on the stack tray 254 via the stack path 252.

The straight path 253 of the large-capacity stacker 200-3*a* is a sheet conveyance path for conveying, to an apparatus in a subsequent stage, the sheet used in the job that does not require processing for stacking the sheet on the stack tray 254 of the large-capacity stacker 200-3*a*.

The sample tray path 251 is a sheet conveyance path for discharging the sheet onto a sample tray 257. The straight path 253, the sample tray path 251, and the sample tray 257 are used to provide an easy access to a print product by making it unnecessary for the user to take out the print product from the stack tray 254. In this case, the control unit 205 performs control for conveying the sheet that has been printed with the printing apparatus 100 onto the sample tray path 251 and discharging the sheet onto the sample tray 257 via the sample tray path 251.

Note that a plurality of sheet detection sensors (not illustrated), which is used to detect a status of conveyance of the sheet and paper jamming, if any, is provided in the sheet conveyance path in the large-capacity stacker 200-3*a*.

In addition, the large-capacity stacker 200-3*a* includes a central processing unit (CPU) (not illustrated). The CPU of the large-capacity stacker 200-3*a* notifies the control unit 205 of information about sheet detection, which has been sent from each sensor to the control unit 205 via a signal line used for performing data communication. The control unit 205 can recognize the state of sheet conveyance and the occurrence of jamming in the large-capacity stacker 200-3*a* according to the information from the large-capacity stacker 200-3*a*.

Note here that in the case where another sheet processing apparatus 200 is provided and connected between the large-capacity stacker 200-3*a* and the printing apparatus 100, then a CPU (not illustrated) of the sheet processing apparatus 200 provided between the large-capacity stacker 200-3*a* and the printing apparatus 100 notifies the information from the sensor of the large-capacity stacker 200-3*a* to the control unit 205.

Now, an exemplary inner configuration of the gluing binding machine 200-3*b* will be described below with reference to the cross section in FIG. 5. Referring to FIG. 5, the gluing binding machine 200-3*b* conveys the sheet that has been conveyed from an upstream apparatus selectively into either one of three conveyance paths, namely, a cover path 261, a textblock path 262, or a straight path 263.

In addition, the gluing binding machine 200-3*b* includes an inserter path 264. The inserter path 264 is a sheet conveyance path used for conveying the sheet that has been set on an inserter tray 265 into the cover path 261.

The straight path 263 of the gluing binding machine 200-3*b* is a sheet conveyance path used for conveying, to an apparatus in a subsequent stage, the sheet used in the job that does not require the gluing binding processing with the gluing binding machine 200-3*b*.

Furthermore, each of the textblock path 262 and the cover path 261 of the gluing binding machine 200-3*b* is a sheet conveyance path used for conveying the sheet necessary for generating a case binding print product.

For example, in the case of generating one case binding print product using the gluing binding machine 200-3*b*, the control unit 205 performs control for printing image data for the text that is to be printed on a sheet for the text of the case binding print product with the printer unit 203. In generating one case binding print product, a sheet stack for one book including sheets for the text is wrapped with one cover sheet. The sheet stack for the text used in case binding is herein referred to as a "textblock".

The control unit 205 performs control for conveying the sheet that has been printed with the printing apparatus 100, which is to be the textblock, into the textblock path 262.

Then, in the case of performing the case binding processing, the control unit 205 performs processing for binding the textblock sheets that have been printed with the printing apparatus 100 with the cover sheet which has been conveyed via the cover path 261.

Figure 5:
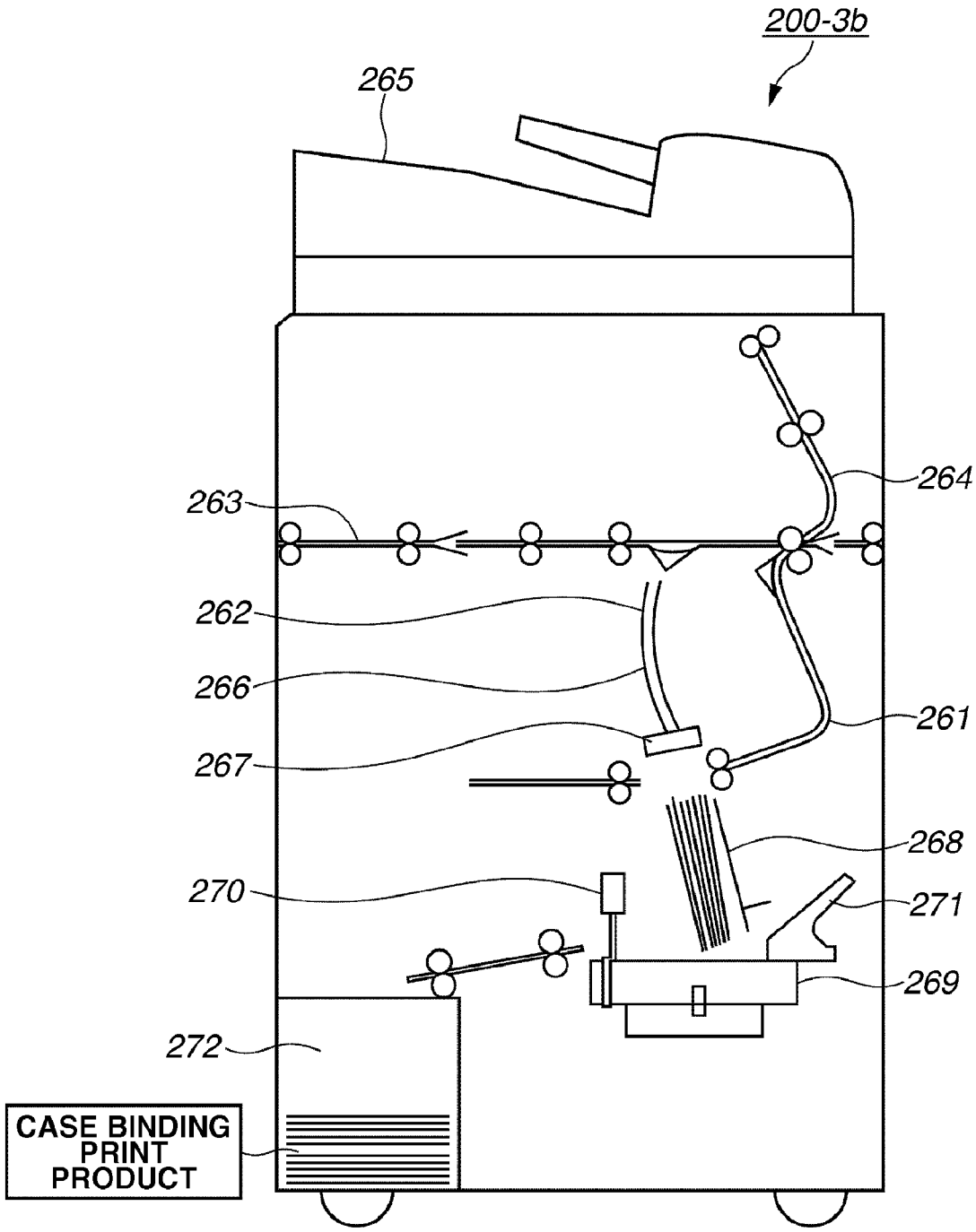
FIG. 5 illustrates an example of an inner configuration of the inline finisher according to an embodiment of the present invention.

For example, the control unit 205 allows the textblock sheets conveyed from an upstream apparatus to be serially stacked in a stacking unit 266 via the textblock path 262 illustrated in FIG. 5. When the sheets onto which the text data is printed are stacked in the stacking unit 266 in an amount equivalent to the number of sheets for one book, the control unit 205 allows one sheet used for the cover required in the job to be conveyed via the cover path 261.

In parallel to the above-described operation, the control unit 205 performs control for gluing a spine portion of one set of the sheet stack, which have been stacked in the stacking unit 266 and are to be used for the textblock, with a gluing unit 267.

After that, the control unit 205 controls the gluing unit 267 so that the gluing unit 267 attaches the spine portion of the textblock to a central portion of the cover sheet. In attaching the textblock to the cover, the textblock is conveyed while being pushed towards a lower portion of the gluing bookbinding machine 200-3*b*.

Thus, the control unit 205 performs processing for folding the cover sheet to wrap the textblock with one cover sheet. Subsequently, one set of sheet stack is stacked on a turntable 269 along a guide 268.

After one set of sheet stack has been set on the turntable 269, the control unit 205 can perform three-edge cutting processing with a cutter unit 270. Here, the three-edge cutting processing refers to processing for cutting three edges of the sheet stack for one set of a book except the spine portion thereof.

More specifically, the control unit 205 performs control for rotating the sheet stack by 90 degrees with the turntable 269 every time the cutting processing for cutting one edge of the sheet stack is performed. When the cutting processing for cutting one edge of the sheet stack is performed on three different edges thereof, the three-edge cutting processing is completed.

Then, the control unit 205 performs control for pressing the sheet that has been subjected to the three-edge cutting processing against a basket 272 with a pressing portion 271. Thus, the sheet stack is stored in the basket 272.

Now, an exemplary inner configuration of the saddle stitch binding machine 200-3*c* will be described below with reference to the cross section in FIG. 6.

The saddle stitch binding machine 200-3*c* includes various units provided for selectively performing various processing, such as stapling processing, cutting processing, punching processing, folding processing, shift discharge processing, or saddle stitch binding processing, on the sheet that has been printed with and sent from the printing apparatus 100, as will be described in detail below.

Furthermore, the saddle stitch binding machine 200-3*c* does not have a straight path that functions as a sheet conveyance path to a downstream apparatus. Therefore, in the case where a plurality of sheet processing apparatuses is connected to the printing apparatus 100, the saddle stitch binding machine 200-3*c* is connected as the last apparatus, as illustrated in FIG. 3.

Figure 6:
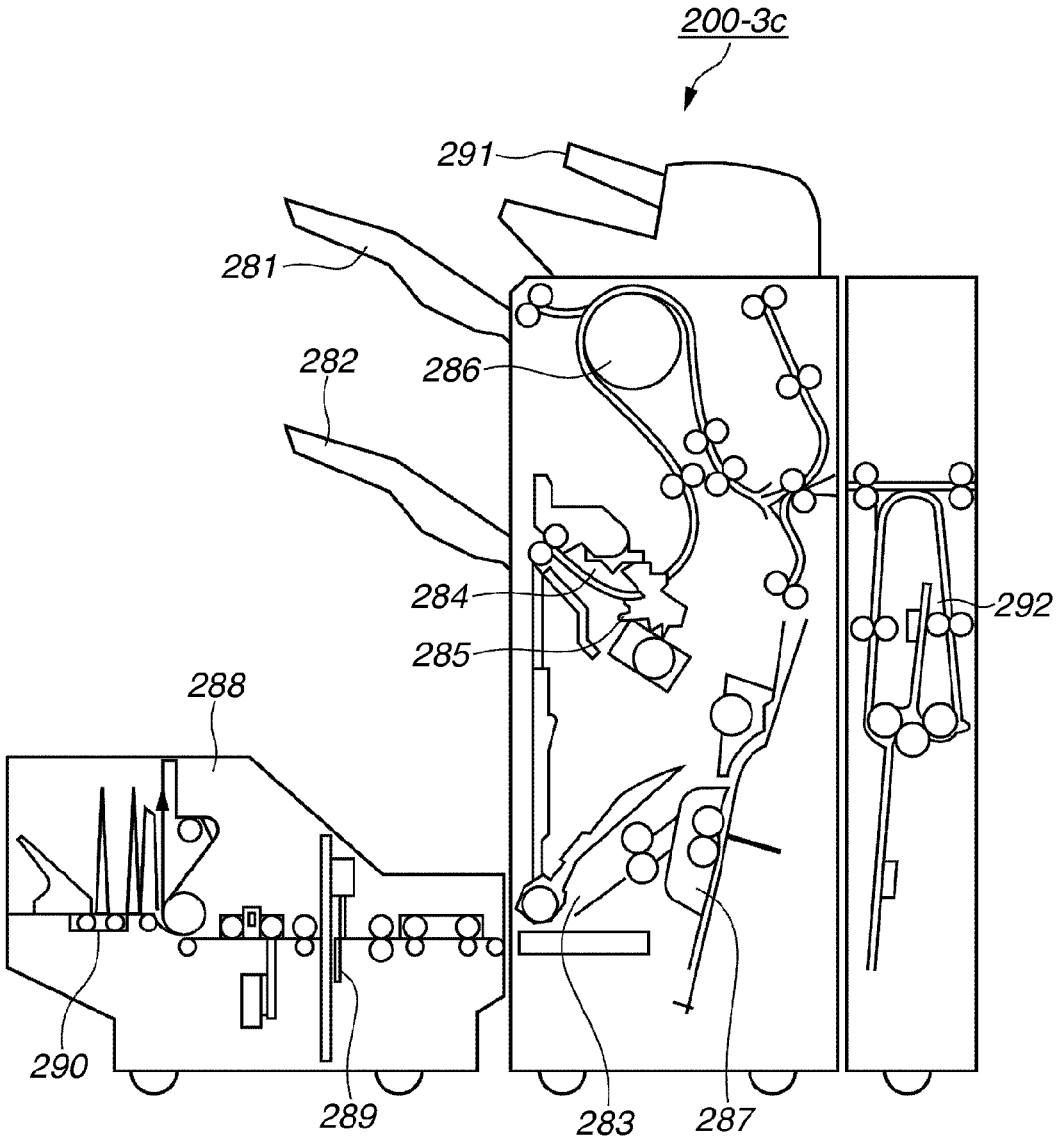
FIG. 6 illustrates an example of an inner configuration of the inline finisher according to an embodiment of the present invention.

In addition, as illustrated in FIG. 6, the saddle stitch binding machine 200-3*c* has a sample tray 281, a stack tray 282, and a booklet tray 283. The sample tray 281 and the stack tray 282 are provided outside the saddle stitch binding machine 200-3*c* while the booklet tray 283 is provided inside the saddle stitch binding machine 200-3*c*.

When the control unit 205 receives an instruction from the user for performing stapling processing with the saddle stitch binding machine 200-3*c*, the control unit 205, at first, performs control for serially stacking the sheet that has been printed with the printing apparatus 100 on a processing tray 284, which is provided in the saddle stitch binding machine 200-3*c*.

After the sheets for one sheet stack are stacked on the processing tray 284, the control unit 205 performs the instructed stapling processing with a stapler 285. Then, the control unit 205 performs control for discharging the stapled sheet stack from the processing tray 284 onto the stack tray 282.

Furthermore, when the control unit 205 receives an instruction from the user for performing a job for which the Z-folding processing with the saddle stitch binding machine 200-3*c* has been designated by the user, the control unit 205 performs processing for folding the sheet that has been printed with the printing apparatus 100 in a Z-like shape with a Z-folding unit 292.

Then, the control unit 205 allows the folded sheet to pass through the saddle stitch binding machine 200-3*c* and to be discharged onto a discharge tray, such as the stack tray 282 or the sample tray 281.

When the control unit 205 receives an instruction for performing the punching processing with the saddle stitch binding machine 200-3*c*, the control unit 205 performs control for performing the instructed punching processing on the sheet that has been printed with the printing apparatus 100 with a puncher unit 286.

Then, the control unit 205 allows the sheet to pass through the saddle stitch binding machine 200-3*c* and to be discharged onto a discharge tray, such as the stack tray 282 or the sample tray 281.

Furthermore, in the case where the control unit 205 performs the job for which the user has issued an instruction for performing the saddle stitch binding processing with the saddle stitch binding machine 200-3*c*, the control unit 205, at first, performs saddle stitching at two positions in a central portion of the sheet stack including a plurality of sheets for one set with a saddle stitcher unit 287. After that, the control unit 205 performs two-folding using the central portion of the sheet stack as a reference by engaging the central portion of the sheet stack with a roller.

In the above-described manner, a leaflet-like booklet can be produced. The sheet stack on which the saddle stitch binding processing has been performed with the saddle stitcher unit 287 as described above is then conveyed onto the booklet tray 283.

Furthermore, when the control unit 205 receives an instruction for performing the cutting processing on the job in which saddle stitch binding processing is instructed to be performed, the control unit 205 performs control for conveying the sheet stack that has been saddle-stitch bound from the booklet tray 283 to a trimmer 288.

Subsequently, the control unit 205 performs control for cutting the sheet stack that has been conveyed to the trimmer 288 with a cutter unit 289. Then, the sheet stack that has been cut with the cutter unit 289 is conveyed to a booklet holding portion 290 to be held therein. Here, note that the saddle stitch binding machine 200-3*c* can perform the three-edge cutting processing on the sheet stack that has been subjected to the saddle stitch binding processing.

It is also to be noted that if the saddle stitch binding machine 200-3*c* does not include a trimmer, the sheet stack that has been bound with the saddle stitcher unit 287 can be taken out of the booklet tray 283.

Furthermore, the saddle stitch binding machine 200-3*c* can add the sheet set on an insertion tray 291 (for example, a cover sheet that has been previously printed) to the sheet that has been printed with the printing apparatus 100 and conveyed from the printing apparatus 100.

Now, a configuration of the operation unit 204 according to the present embodiment will be described in detail below with reference to FIG. 7.

Referring to FIG. 7, the operation unit 204 includes a touch panel unit 401 and a key input unit 402.

The touch panel unit 401 is constituted by a liquid crystal display (LCD) and a transparent electrode attached on the LCD. The touch panel 401 displays various setting screens used for receiving an instruction from the user.

That is, the touch panel 401 not only functions to display various setting screens but also functions to input an instruction to receive an instruction from the user.

The key input unit 402 includes a power key 501, a start key 503, a stop key 502, a reset key 504, a user mode key 505, a numeric keypad 506, and a clear key 507. Here, the start key 503 can be operated by the user to issue an instruction for starting a copy job or a send job by the printing apparatus 100. The numeric keypad 506 can be operated by the user to enter a numerical value for a print setting item, such as the number of print copies. The clear key 507 is can be operated by the user to clear various parameters set with the numeric keypad 506.

The control unit 205 controls the printing system 1000 so that the printing system 1000 performs various processing according to a user instruction received via various screens displayed on the touch panel 401 and a user instruction received via the key input unit 402.

Figure 8:
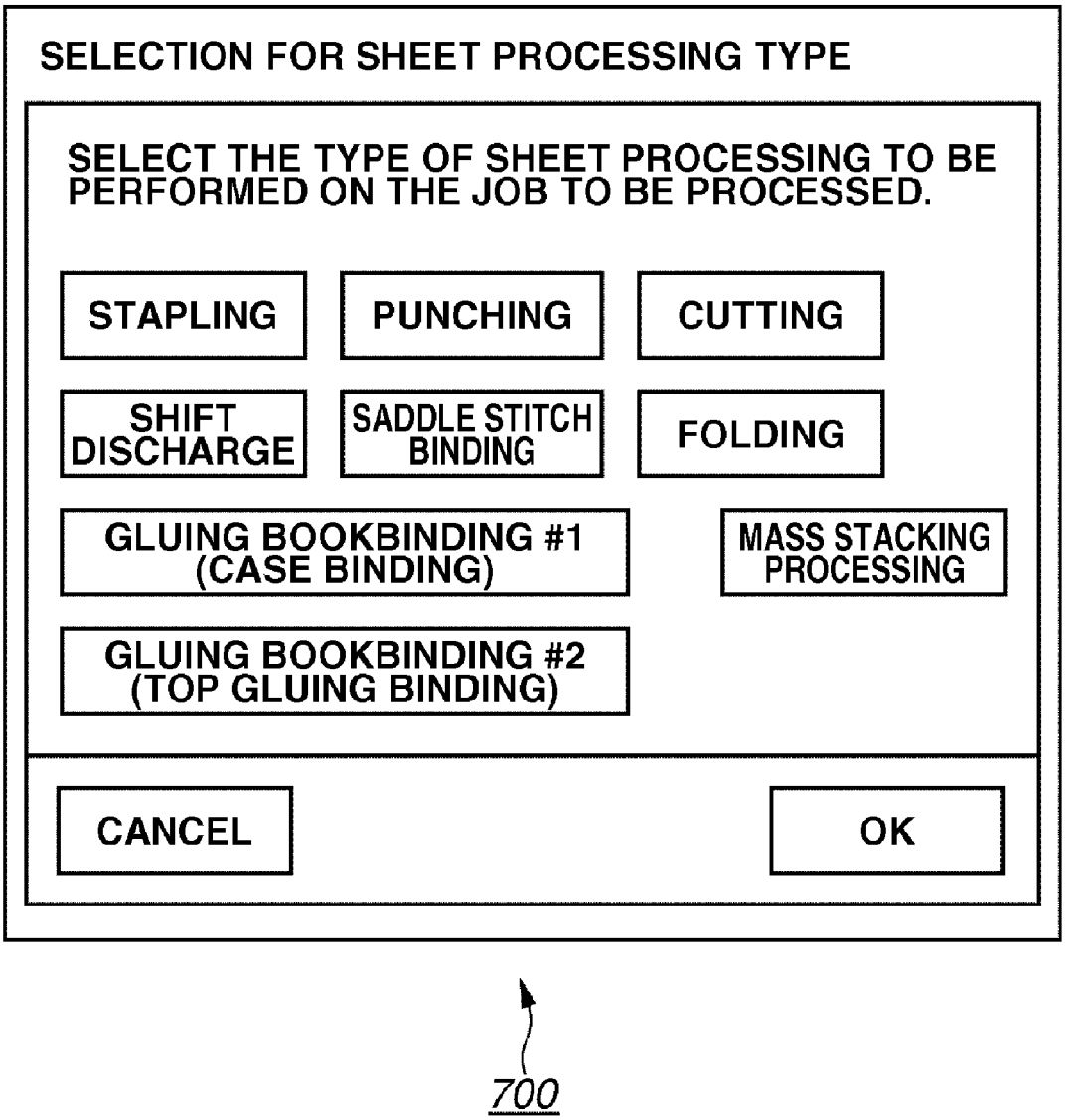
FIG. 8 illustrates an example of a screen displayed on the operation unit according to an embodiment of the present invention.

FIG. 8 illustrates an example of a setting screen 700 used for allowing the user to select a type of the sheet processing to be performed on the sheet that has been printed with the printing apparatus 100 according to the present embodiment.

Referring to FIG. 8, when the user presses a sheet processing setting key 609 (FIG. 7) in the screen displayed on the touch panel unit 401 (FIG. 7), the control unit 205 displays the setting screen 700 illustrated in FIG. 8 on the touch panel unit 401. The setting screen 700 illustrated in the example in FIG. 8 is a setting screen configured so that the user can select a type of sheet processing that can be performed with the sheet processing apparatus 200 in the printing system 1000.

The control unit 205 receives the settings for the sheet processing to be performed during a job to be processed via the setting screen 700 in FIG. 8. Then, the control unit 205 performs the sheet processing with the sheet processing apparatus 200 according to the received settings.

Figure 9:
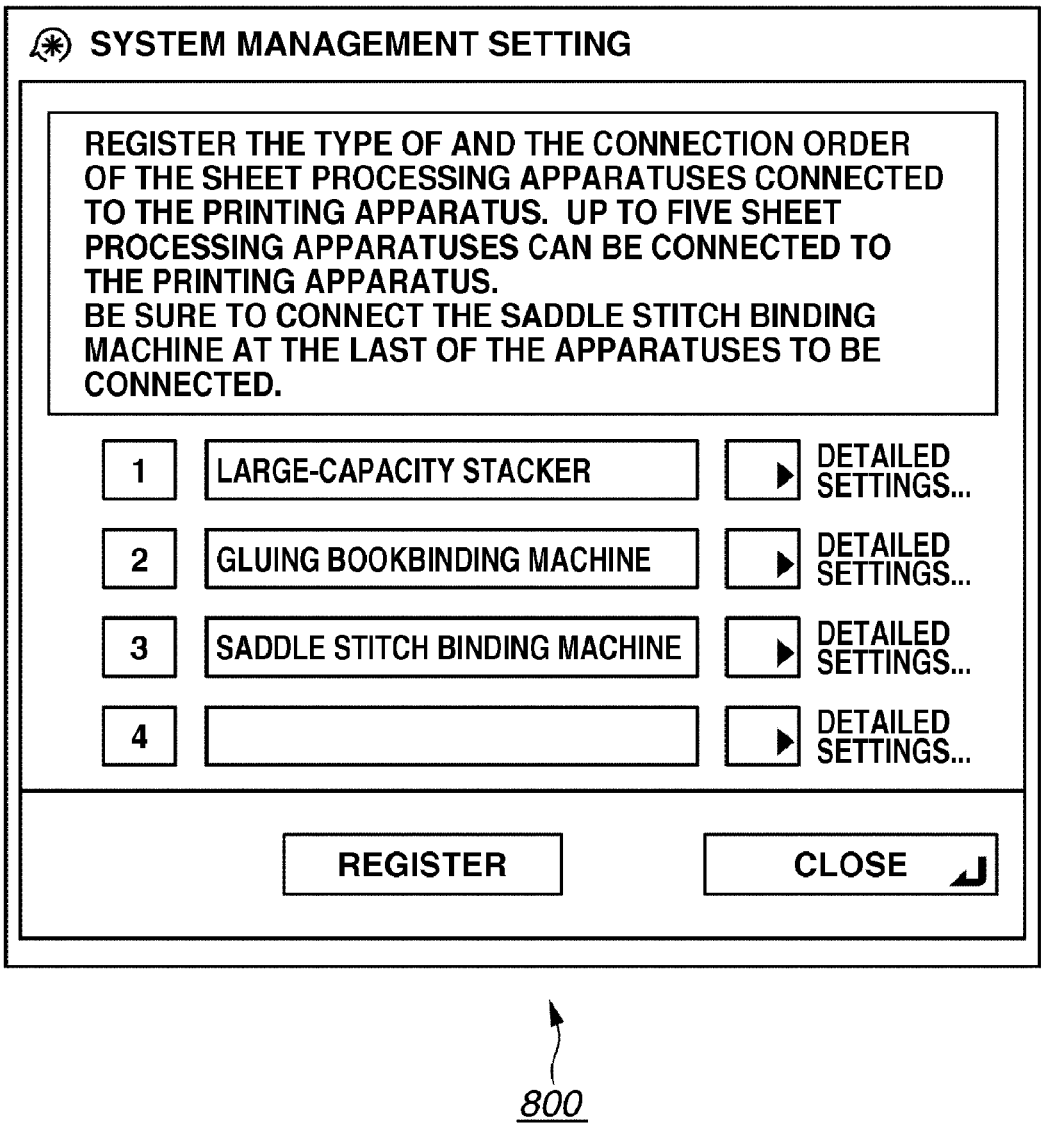
FIG. 9 illustrates an example of a screen displayed on the operation unit according to an embodiment of the present invention.

Furthermore, a setting screen 800 illustrated in FIG. 9 is configured so that in a case where the sheet processing apparatus 200 is connected to the printing apparatus 100, the user can register information for performing a designation as to the types, number, and order of sheet processing apparatuses 200 connected to the printing apparatus 100. When the user presses the user mode key 505 (FIG. 7), the control unit 205 performs control so that the setting screen 800 illustrated in FIG. 9 can be displayed on the touch panel 401.

For example, in a case where the printing system 1000 has the system configuration illustrated in FIG. 3, the user sets, via the setting screen 800, registration information indicating that three sheet processing apparatuses 200, namely, the large-capacity stacker 200-3*a*, the gluing bookbinding machine 200-3*b*, and the saddle stitch binding machine 200-3*c*, are connected to the printing apparatus 100 in this order.

In this case, the control unit 205 stores the information related to the sheet processing apparatus 200 set by the user via the setting screen 800 in the RAM 208 as system configuration information, and reads and refers to the stored information as necessary. Thus, the control unit 205 verifies the type of sheet processing that can be performed by the sheet processing apparatuses 200 and how many sheet processing apparatuses 200 are connected to the printing apparatus 100 in what order.

Suppose that the user has performed a setting via the setting screen 800 in FIG. 9 so that a saddle stitch binding machine having no straight path is connected at some midpoint of the combination of a plurality of sheet processing apparatuses 200. In this case, the control unit 205 disables the setting and displays an error message on the touch panel 401.

In addition, as illustrated in FIG. 9, it is also useful if the control unit 205 displays guidance information for making a notification for prompting the user to connect the saddle stitch binding machine at the last of tandem of the sheet processing apparatuses 200 without performing such setting.

In the present embodiment, the operation unit 204 included in the printing apparatus 100 is described as an example of a user interface unit applied in the printing system 1000. However, the configuration is not limited to this. For example, the printing system 1000 can perform the processing according to an instruction generated via the user interface unit included in an external apparatus, such as the PC 103 or the PC 104.

Figure 10:
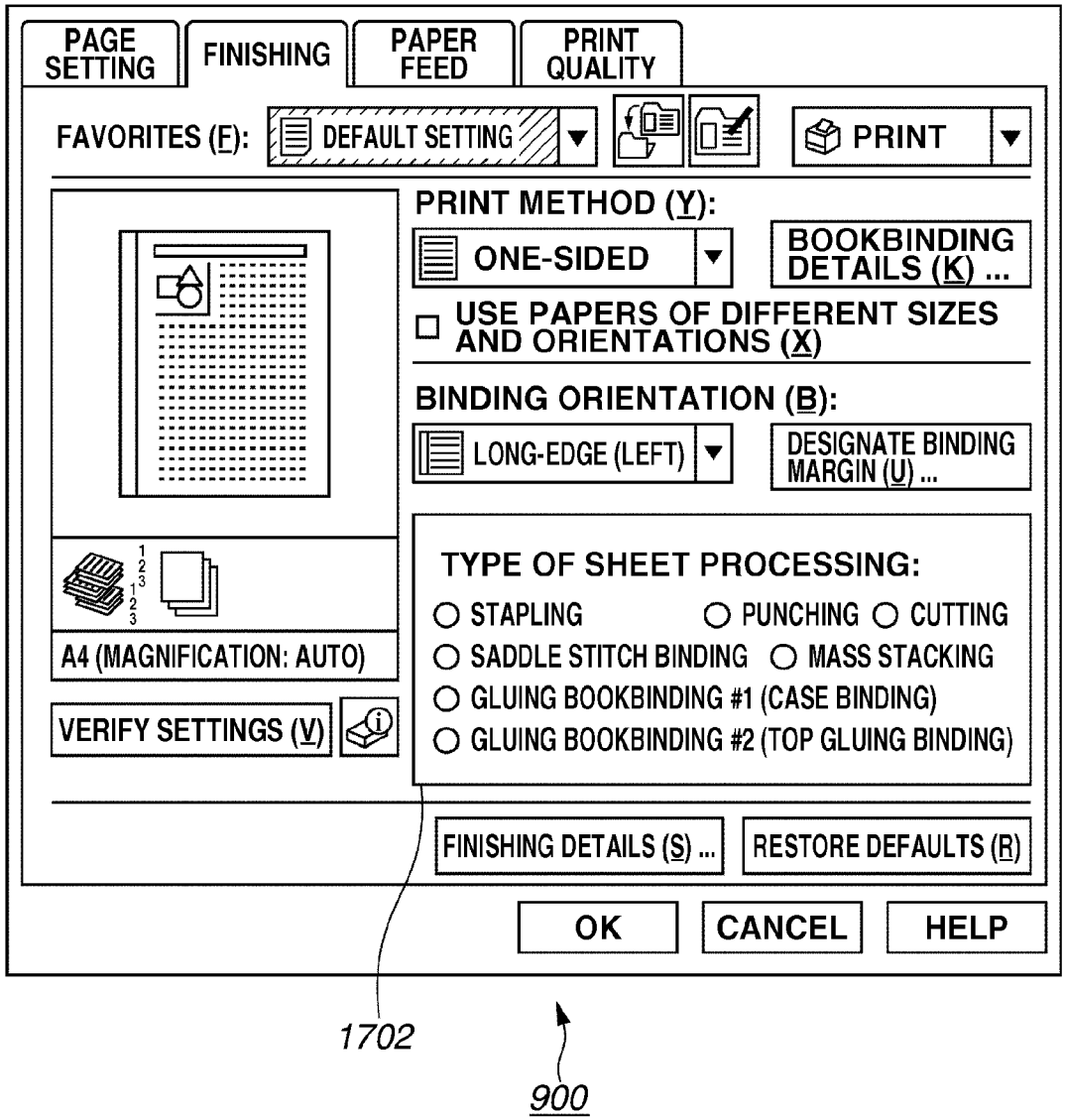
FIG. 10 illustrates an example of a screen displayed on a personal computer (PC) according to an embodiment of the present invention.

In remotely operating the printing system 1000 from an external apparatus, a setting screen 900 related to the printing system 1000 illustrated in FIG. 10 is displayed on a display unit of the external apparatus. A description thereof will now be made below using the PC 104 as an example.

FIG. 10 illustrates an example of the setting screen 900 displayed on a display of the PC 104 according to the present embodiment.

Referring to FIG. 10, a CPU included in the PC 104, when the CPU receives a print request from the user, displays the setting screen 900 illustrated in FIG. 10 on the display of the PC 104 via the setting screen 900, and then receives the settings set by the user of the PC 104 via the setting screen 900 as a print processing condition.

For example, the CPU of the PC 104 receives from the user the type of the sheet processing to be performed by the sheet processing apparatus 200 with respect to a print job that is requested from the PC 104 via a setting field 1702.

When a request for performing printing is received upon pressing of an OK key in FIG. 10, the CPU of the PC 104 performs control so that the print processing condition input via the setting screen 900 and the image data to be printed are linked with each other as one job and the job including the print processing condition and the image data is sent to the printing system 1000 via the network 101.

In the printing system 1000, when receiving the print request for printing the job via the external I/F unit 202, the control unit 205 performs control of the printing system 1000 so that the printing system 1000 performs print processing for the job received from the PC 104 according to the print processing condition input by the user via the PC 104. As described above, various units, as well as the operation unit 204, can be provided in the printing system 1000 as the user interface thereof.

In the printing system 1000 having the above-described configuration, the control unit 205 performs various adjustment operations, which will be described in detail below, in the printing system 1000 at a predetermined timing.

Note that in the present embodiment, the print job received from a host PC is described as an example of the job to be processed. However, the type of the job to be processed according to the present embodiment is not limited to this. That is, a copy job can be performed in the present embodiment.

The adjustment operation performed by the control unit 205 includes a density adjustment operation, a gradation correction operation, a glue temperature adjustment operation, and a paper feed unit adjustment operation.

The density adjustment operation refers to an adjustment operation for adjusting the printing density (the amount of toner) based on a result of reading a test pattern patch, which has been previously output on the surface of the photosensitive drum 304, with a sensor (not illustrated).

The gradation correction operation is an adjustment operation for correcting the gradation based on a result of a detection of a color patch, which has been previously output on the surface of the photosensitive drum 304, with a sensor (not illustrated).

The glue temperature adjustment operation is an adjustment operation for adjusting the temperature of a heater to dissolve a glue used in bookbinding processing performed within the gluing binding machine 200-3*b* illustrated in FIG. 5.

The paper feed unit adjustment operation is an adjustment operation for adjusting the printing positions of images printed on both sides of the sheet in the case of the two-sided printing according to the type of the print medium. For example, by performing the paper feed unit adjustment operation, the type of a printing medium set in the paper feed unit is detected at first and then the print positions for printing the images on both sides of the sheet are adjusted according to the type of the print medium.

The control unit 205 automatically performs the above-described adjustment operation at a predetermined timing. While performing the adjustment operation, the control unit 205 does not perform the print job because if a print job is performed while the adjustment operation is executed, a quality of the print product may degrade.

That is, in the present embodiment, the control unit 205 performs a print job after completing an adjustment operation to prevent the print product quality from degrading. Note here that the above-described predetermined timing for performing an adjustment operation will be described in detail later below.

On the other hand, in the printing system 1000, the control unit 205 interrupts the execution of a print job in response to the occurrence of an operation failure, such as "cassette-open", "no paper", or "full-stack on tray". In the present embodiment, the operation failure is hereafter referred to as a "print interruption factor".

More specifically, the print interruption factor "cassette-open" refers to a state in which the paper cassette 317 or 318 is opened to replenish sheets therein. When detecting that the paper cassette, which is a paper feeding source, is open with a sensor (not illustrated) provided to the paper cassette, the control unit 205 interrupts the execution of a print job because the sheets to be used in the print processing cannot be fed from the paper cassette.

The print interruption factor "no paper" refers to a state in which no sheet exists in the paper cassette 317 or 318, which is a paper feeding sources. When detecting that no sheet exists in the paper cassette, which is a paper feeding source, with a sensor for detecting the presence of a paper sheet (not illustrated) of the paper feeding source (paper cassette), the control unit 205 interrupts the execution of a print job because the sheets to be used in the print processing cannot be fed from the paper cassette.

The print interruption factor "full-stack on tray" refers to a state in which the paper discharge tray, which is a paper discharge destination, is full of sheets stacked thereon. When detecting that the paper discharge tray, which is a paper discharge destination, is full of sheets stacked thereon with a sensor (not illustrated) of the paper discharge tray (paper discharge destination) for detecting a full-stack state, the control unit 205 interrupts the execution of a print job because the printed sheet cannot be discharged on the paper discharge tray.

In the printing system 1000 according to the present embodiment, the control unit 205 automatically performs an adjustment operation at a predetermined timing as described above. In addition, the control unit 205 performs control so that the adjustment operation can be performed when a print interruption factor has occurred.

Figure 11:
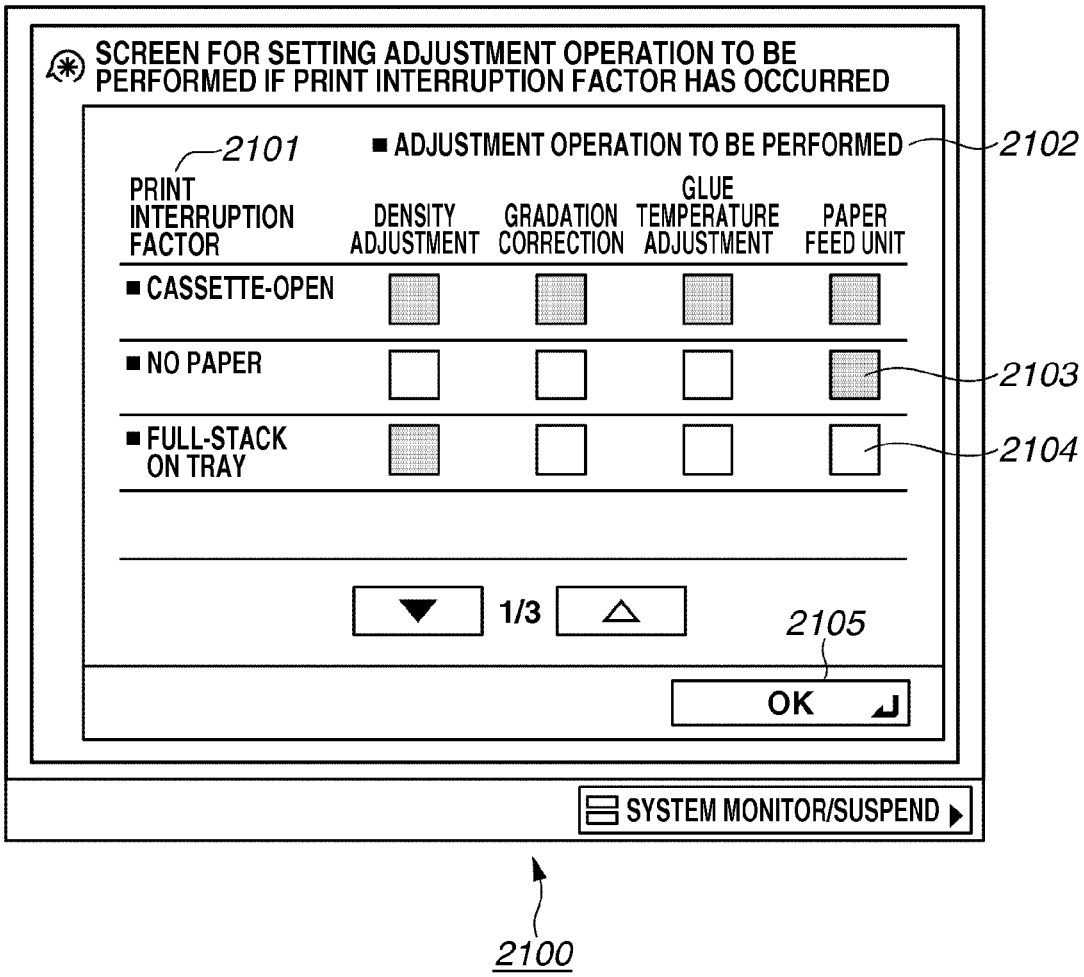
FIG. 11 illustrates an example of a screen displayed on the operation unit according to an embodiment of the present invention.

FIG. 11 illustrates an example of a setting screen 2100, via which the user can perform a setting for the adjustment operation that is to be performed when a print interruption factor has occurred.

Referring to FIG. 11, the user can designate the adjustment operation to be performed when a print interruption factor has occurred in the printing system 1000 via the setting screen 2100. The control unit 205 receives, from the user via the setting screen 2100, a setting for the adjustment operation that is to be performed when a print interruption factor has occurred in the printing system 1000.

In the setting screen 2100 illustrated in FIG. 11, each of a plurality of buttons 2103 and 2104 is disposed within the setting screen 2100 in correspondence with each print interruption factor listed in a field 2101 and each adjustment operation listed in a field 2102, which also corresponds to each of the print interruption factors listed in the field 2101.

More specifically, the control unit 205 performs control so that a button that corresponds to the adjustment operation that has been set to be performed when a print interruption factor listed in the field 2101 has occurred, among the plurality of buttons, is displayed in a highlighted state (that is, in a designatable state) as indicated by the button 2104 in FIG. 11.

On the other hand, the control unit 205 performs control so that a button that corresponds to the adjustment operation that has been set not to be performed when a print interruption factor listed in the field 2101 has occurred is displayed in a non-highlighted state (that is, in an undesignatable state) as indicated by the button 2103 in FIG. 11.

FIG. 12 illustrates an example of a configuration of a table that stores a setting for the adjustment operation that has been set by the user to be performed when a print interruption factor has occurred according to the present embodiment. Here, the table illustrated in FIG. 12 is generated by the control unit 205 according to the setting set by the user via the setting screen 2100 (FIG. 11). Hereinafter, the table is referred to as a "correspondence table".

For example, the control unit 205 stores the correspondence table illustrated in FIG. 12 on the HDD 209 when an OK key 2105 is pressed by the user in a state illustrated in FIG. 11.

More specifically, the control unit 205 stores a parameter "o" (or "available") with respect to the adjustment operation that has been set by the user via the setting screen 2100 (FIG. 11) to be performed when a print interruption factor has occurred. On the other hand, the control unit 205 stores a parameter "x" (or "not available") with respect to the adjustment operation that has been set by the user via the setting screen 2100 (FIG. 11) not to be performed when a print interruption factor has occurred.

After storing the parameters in the correspondence table illustrated in FIG. 12, when a print interruption factor has occurred in the printing system 1000, the control unit 205 refers to the correspondence table to determine whether any adjustment operation has been set to be performed.

FIG. 13 illustrates an example of a configuration of a table for managing various information related to each adjustment operation according to the present embodiment. Here, the information related to each adjustment operation can include information about history of performing each adjustment operation, time information indicating a timing for performing a next adjustment operation, information about the number of prints that indicates the number of prints available before performing the next adjustment operation, or an estimated time required for performing each adjustment operation. The table illustrated in FIG. 13 is stored on the HDD 209. The table stored on the HDD 209 is updated as necessary. The table illustrated in FIG. 13 is hereafter referred to as an "information table".

More specifically, in the example illustrated in FIG. 13, the control unit 205 records the time at which the last adjustment operation was performed in a "time of last performance" field, for example. Furthermore, the control unit 205 performs the following control. That is, the control unit 205 adds a predetermined time to the time of last performance held in the information with respect to each adjustment operation. Moreover, the control unit 205 determines a time schedule for performing a next adjustment operation. The control unit 205 holds the time schedule for performing the next adjustment operation in a "time for performing next periodical operation" field of the information table illustrated in FIG. 13.

More specifically, suppose here that it has been set by the user to perform a density adjustment operation fifteen minutes after the time of last performance. In this case, the control unit 205 sets a time fifteen minutes later than the time of performance of the last density adjustment operation, which can be calculated by adding fifteen minutes thereto as described above, in the "time for performing next periodical operation" field.

Furthermore, suppose that it has been set by the user to perform a gradation correction operation twenty minutes after the time of last performance. In this case, the control unit 205 sets a time twenty minutes later than the time of last performance, at which the last density adjustment operation was performed, which can be calculated by adding twenty minutes thereto as described above, in the "time for performing next periodical operation" field.

The control unit 205 periodically performs the adjustment operation according to the information held in the information table illustrated in FIG. 13. For example, the control unit 205 refers to a timer (not illustrated) to acquire the current time. Furthermore, the control unit 205 determines whether it is time for performing each next periodical adjustment operation. If it is determined that it is time for performing a next periodical adjustment operation, then the control unit 205 performs the adjustment operation whose next periodical performance time has come in the printing system 1000.

Furthermore, the control unit 205 uses a table for storing and managing the number of print copies available before performing the adjustment operation and information about each adjustment operation.

In this regard, the control unit 205 subtracts a value equivalent to the number of sheets that have been output during the print processing from a value recorded in the "number of remaining prints before adjustment operation" field.

Then, the control unit 205 performs control so that the adjustment operation is performed if it is determined that the value recorded in the "number of remaining prints before adjustment operation" field has decreased to "0".

Furthermore, after performing the adjustment operation in the above-described case, the control unit 205 resets the value held in the "number of remaining prints before adjustment operation" field.

More specifically, in performing the adjustment operation in the above-described case, the control unit 205 sets a predetermined value for the number of sheets with respect to each adjustment operation in the "number of remaining prints before adjustment operation" field in the information table illustrated in FIG. 13. In this regard, for example, in the case where it has been set by the user to perform the density adjustment operation if it is determined that eight hundred sheets have been printed after the last density adjustment operation was performed, the control unit 205 sets a value "800" in the "number of remaining prints before adjustment operation" field (FIG. 13) during the density adjustment operation.

In the example of the information table illustrated in FIG. 13, the information table holds the values that are held therein in the case where the control unit 205 has performed a density adjustment operation at a predetermined timing, then has set a predetermined number of prints (in this case, 800 prints), and then has performed a print job for printing on 300 sheets.

Note that with respect to the glue temperature adjustment operation, among the plurality of types of adjustment operations, no value is set in the "number of remaining prints before adjustment operation" field in the example illustrated in FIG. 13. This is because in the example illustrated in FIG. 13, it has been set by the user so that the control unit 205 does not perform the glue temperature adjustment operation based on the number of prints.

In the present embodiment, the number of print copies is counted by subtracting the value for the number of sheets that have been output during the print processing from a predetermined number of prints as described above. However, the present embodiment is not limited to this.

That is, it is also useful if the control unit 205 counts the number of sheets that have been output during the print processing and performs control so that the adjustment operation is performed again if the number of sheets that have been output during the print processing has reached or exceeded a predetermined value. In this case, the control unit 205 resets the value for the number of sheets to be counted to "0" after performing the adjustment operation.

Furthermore, in the present embodiment, the time for performing a next periodical adjustment operation is determined by setting a time fifteen minutes later than the "time of last performance" as the "time for performing next periodical operation". Furthermore, the control unit 205 performs the adjustment operation when the "time for performing next periodical operation" has come.

However, the present embodiment is not limited to this. That is, it is also useful if the control unit 205 calculates the time elapsed since the time of performance of the last adjustment operation and performs control so that the adjustment operation is performed when the elapsed time reaches or exceeds a predetermined length of time.

Furthermore, it is also useful if the control unit 205 sets a predetermined time in the table, calculates the time elapsed since the predetermined time set in the table, subtracts the calculated time elapsed since the predetermined time set in the table, and performs control so that the adjustment operation is performed when the value obtained by subtracting the calculated time elapsed since the predetermined time set in the table has been decreased to "0".

Now, an example of the control performed by the control unit 205 according to the present embodiment will be described in detail below with reference to the flow chart of FIG. 14.

Note that in the present embodiment, a case is described as an example where the user has pressed the OK key 2105 (FIG. 11) in a state where the setting has been performed by the user as illustrated in FIG. 11 and where the control unit 205 has generated the correspondence table (FIG. 12) and the generated correspondence table is stored on the HDD 209.

Figure 14:
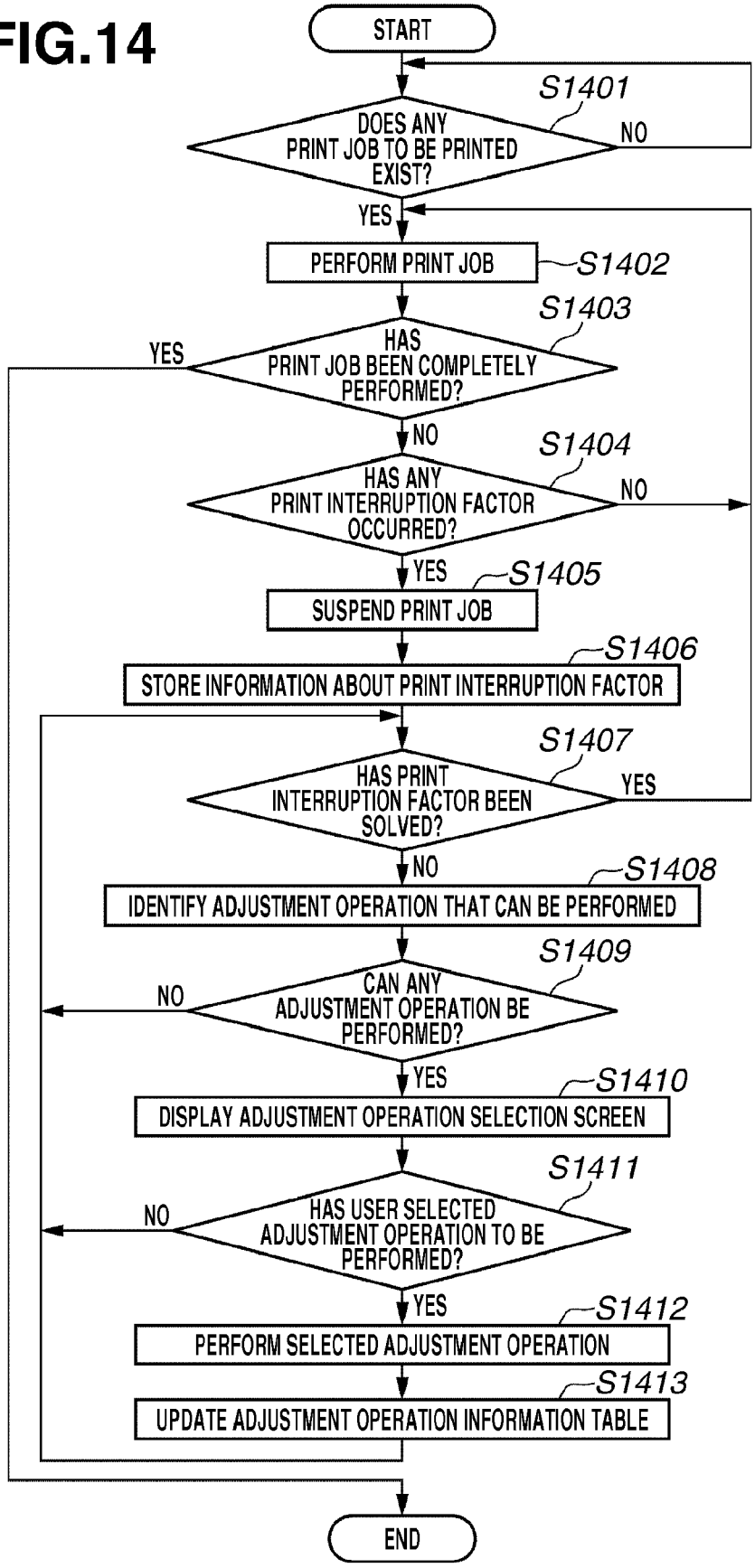
FIG. 14 is a flow chart that illustrates an example of control processing according to an embodiment of the present invention.

Referring to FIG. 14, in step S1401, the control unit 205 determines whether the user has set a print job to be performed. For example, if it is determined in step S1401 that a print job that has been received from the PC 103 or a copy job for which a request for performing the same has been input by the user by operating the start key 503 is stored on the HDD 209 (YES in step S1401), then the processing advances to step S1402. Note that in the following description, a print job and a copy job whose request for performing the same has been received by the printing system 1000 from an external apparatus, such as the PC 103, are correctively referred to as a "print job".

On the other hand, if it is determined in step S1401 that no print job to be performed has been set by the user (NO in step S1401), then the control unit 205 repeats the processing in step S1401.

In step S1402, the control unit 205 starts processing for the print job to be performed. Then, the processing advances to step S1403.

In step S1403, the control unit 205 determines whether the print job whose print request has been received in step S1401 is completed.

If it is determined in step S1403 that that the print job whose print request has been received in step S1401 is completed (YES in step S1403), then the control unit 205 ends the processing. On the other hand, if it is determined in step S1403 that, the print job whose print request has been received in step S1401 is not completed yet (NO in step S1403), then the processing advances to step S1404.

In step S1404, the control unit 205 determines whether a print interruption factor, such as "cassette-open", "no paper", or "full-stack on tray", has occurred during the processing for the print job.

If it is determined in step S1404 that a print interruption factor has occurred during the processing for the print job (YES in step S1404), then the processing advances to step S1405. On the other hand, if it is determined in step S1404 that no print interruption factor has occurred during the processing for the print job (NO in step S1404), then the processing returns to step S1402.

In step S1405, the control unit 205 suspends (interrupts) the print job. Then, the processing advances to step S1406.

In step S1406, the control unit 205 stores information about the print interruption factor that has occurred during the processing for the print job on the RAM 208.

In this regard, the control unit 205 stores information about the type of the print interruption factor that has occurred (information about which of "cassette-open", "no paper", and "full-stack on tray" the print interruption factor is) and information about the time at which the print interruption factor has occurred, for example, as information about the print interruption factor.

Furthermore, if the print processing is interrupted according to a signal indicating that the paper feed unit is open from a paper feed unit open/close state sensor (not illustrated), which is provided to the paper feed unit, then the control unit 205 stores information indicating that the print interruption factor "cassette-open" has occurred on the RAM 208.

Furthermore, if a signal indicating that no sheet exists in the paper feed unit is sent from a sensor of the paper feed unit for detecting the presence of the sheet and the processing for the print job is interrupted according thereto, then the control unit 205 stores information indicating that the print interruption factor "no paper" has occurred on the RAM 208.

Furthermore, if a signal indicating that the paper discharge tray is full of sheets discharged thereon is sent from a sensor of the paper discharge tray for detecting a sheet full-stack state of the paper discharge tray and the processing for the print job is interrupted according thereto, then the control unit 205 stores information indicating that the print interruption factor "full-stack on tray" has occurred on the RAM 208. Then, the processing advances to step S1407.

In step S1407, the control unit 205 determines whether the print interruption factor has been solved.

More specifically, if it is determined in step S1404 that the print interruption factor "cassette-open" has occurred (YES in step S1404) and if it is then detected by the sensor of the paper feed unit for detecting an open/close state that the paper cassette that was open has now been closed, then the control unit 205 determines that the print interruption factor has been solved in step S1407.

Furthermore, if it is determined in step S1404 that the print interruption factor "no paper" has occurred (YES in step S1404) and if it is then detected by the sensor of the paper feed unit for detecting the presence of the sheet that the sheet has been replenished in the paper cassette that is a paper feeding source, then the control unit 205 determines that the print interruption factor has been solved in step S1407.

In addition, if it is determined in step S1404 that the print interruption factor "full-stack on tray" has occurred (YES in step S1404) and if no signal indicating that the print interruption factor "full-stack on tray" has occurred is received from the sensor of the paper feed unit for detecting the paper stacking state when the sheet stacked on the paper discharge tray that is an output destination is removed, then the control unit 205 determines that the print interruption factor has been solved in step S1407.

If it is determined in step S1407 that the print interruption factor has been solved as described above (YES in step S1407), then the control unit 205 deletes information about the print interruption factor stored on the RAM 208. Then, the processing advances to step S1402. On the other hand, if it is determined in step S1407 that the print interruption factor has not been solved (NO in step S1407), then the processing advances to step S1408.

In step S1408, the control unit 205 refers to the correspondence table illustrated in FIG. 12 according to the information about the print interruption factor stored on the RAM 208 to identify the adjustment operation that can be performed. In step S1409, the control unit 205 determines whether any adjustment operation that can be performed exists.

If it is determined as a result of the determination in step S1409 that no adjustment operation that can be performed exists (NO in step S1409), then the processing returns to step S1407. On the other hand, if it is determined as a result of the determination in step S1409 that an adjustment operation that can be performed exists (YES in step S1409), then the processing advances to step S1410.

In this regard, for example, if it is determined in step S1404 that the print interruption factor "cassette-open" has occurred (YES in step S1404) and if it is determined in step S1407 that the print interruption factor "cassette-open" has not been solved (NO in step S1407), then the processing advances to step S1408. In step S1408, the control unit 205 refers to the correspondence table (FIG. 12) according to the information about the print interruption factor stored on the RAM 208 to identify the adjustment operation that can be performed. In step S1409, the control unit 205 determines whether any adjustment operation that can be performed exists. If it is determined in step S1409 that no adjustment operation that can be performed exists (NO in step S1409), then the processing advances to step S1407.

On the other hand, for example, if it is determined in step S1404 that the print interruption factor "no paper" has occurred (YES in step S1404) and if it is determined in step S1407 that the print interruption factor "no paper" has not been solved (NO in step S1407), then the processing advances to step S1408. In step S1408, the control unit 205 refers to the correspondence table (FIG. 12) according to the information about the print interruption factor stored on the RAM 208 to identify the adjustment operation that can be performed. In step S1409, the control unit 205 determines whether any adjustment operation that can be performed exists. Here, the control unit 205 determines that "density adjustment operation", the "gradation correction operation", and the "glue temperature adjustment", among a plurality of adjustment operations, can be performed. In addition, in this case, for example, the control unit 205 determines that the "paper feed unit adjustment operation" has been inhibited by the user. Then, the processing advances to step S1410 because it is determined in step S1409 that the adjustment operation that can be performed exists.

Furthermore, for example, if it is determined in step S1404 that the print interruption factor "full-stack on tray" has occurred (YES in step S1404) and if it is determined in step S1407 that the print interruption factor "full-stack on tray" has not been solved (NO in step S1407), then the processing advances to step S1408. In step S1408, the control unit 205 refers to the correspondence table (FIG. 12) according to the information about the print interruption factor stored on the RAM 208 to identify the adjustment operation that can be performed. In step S1409, the control unit 205 determines whether any adjustment operation that can be performed exists. In this case, for example, the control unit 205 determines that the "gradation correction operation", the "glue temperature adjustment operation", and the "paper feed unit adjustment operation", among a plurality of adjustment operations, can be performed. In addition, in this case, the control unit 205 determines that the "density adjustment operation" has been inhibited by the user. Then, the processing advances to step S1410 because it is determined in step S1409 that the adjustment operation that can be performed exists.

Figure 15:
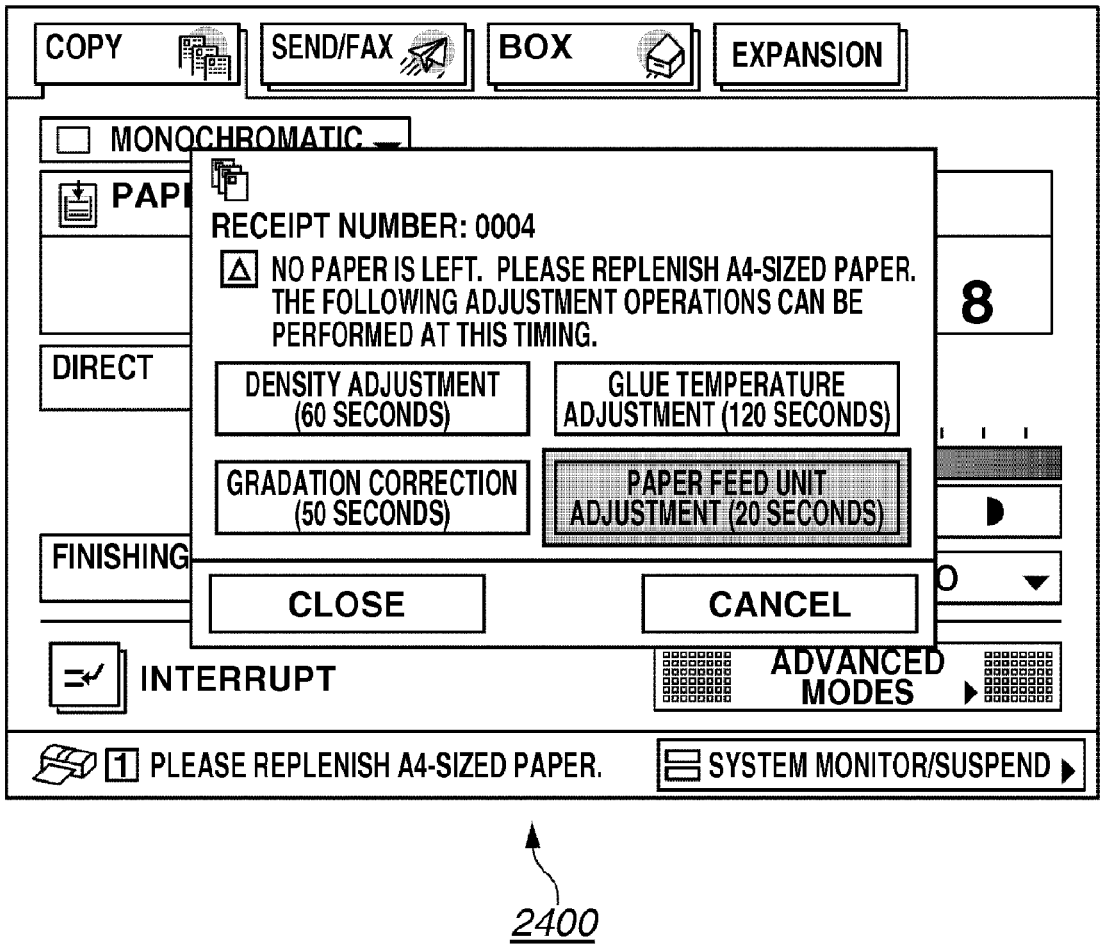
FIG. 15 illustrates an example of a screen displayed on the operation unit according to an embodiment of the present invention.
Figure 16:
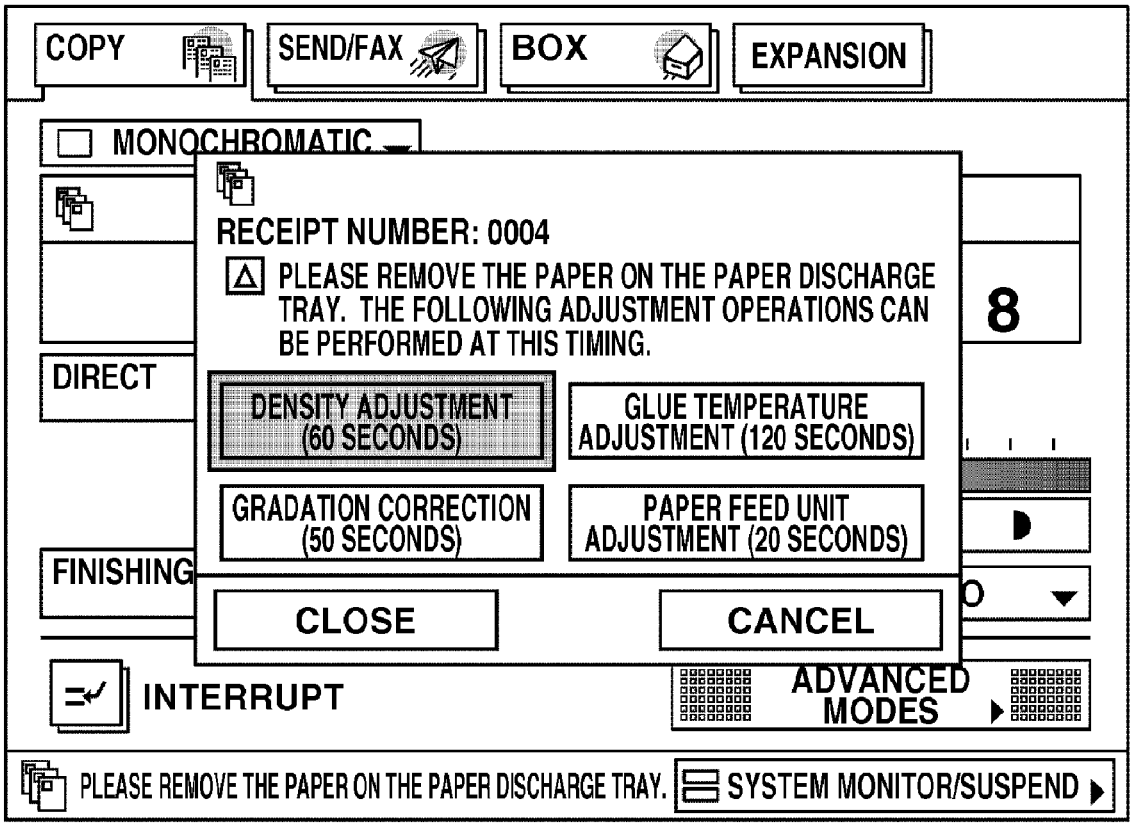
FIG. 16 illustrates an example of a screen displayed on the operation unit according to an embodiment of the present invention.

In step S1410, the control unit 205 displays an adjustment operation selection screen 2400 illustrated in FIG. 15 or FIG. 16 on the operation unit 204 according to the information about the adjustment operation that has been identified in step S1408.

For example, if it is determined in step S1404 that the print interruption factor "no paper" has occurred (YES in step S1404) and if it is determined in step S1407 that the print interruption factor "no paper" has not been solved (NO in step S1407), then the control unit 205 displays the adjustment operation selection screen 2400 on the operation unit 204 in step S1410 as illustrated in FIG. 15. In the example illustrated in FIG. 15, the control unit 205 displays the "density adjustment operation", the "gradation correction operation", and the "glue temperature adjustment" so that the user can select the adjustment operation to be performed from among them and displays the "paper feed unit adjustment operation" in a gray-out state so that the user cannot select it.

Furthermore, for example, if it is determined in step S1404 that the print interruption factor "full-stack on tray" has occurred (YES in step S1404) and if it is determined in step S1407 that the print interruption factor "full-stack on tray" has not been solved (NO in step S1407), then the control unit 205 displays the adjustment operation selection screen 2400 on the operation unit 204 in step S1410 as illustrated in FIG. 16. In the example illustrated in FIG. 16, the control unit 205 displays the "gradation correction operation", the "glue temperature adjustment", and the "paper feed unit adjustment operation" so that the user can select the adjustment operation to be performed from among them and displays the "density adjustment operation" in a gray-out state so that the user cannot select it.

As described above, the control unit 205 displays the selection candidates to the user to enable the user to select the adjustment operation to be performed.

Furthermore, it is also useful if the control unit 205 refers to the information table illustrated in FIG. 13 that holds the information about the adjustment operation and displays the estimated time required to perform the adjustment operation as illustrated in FIG. 15 and FIG. 16. In this case, the user can determine whether to perform the adjustment operation according to the displayed information about the time required to perform the adjustment operation.

As described above, the user can recognize the time required for performing the various adjustment operations. Thus, the user can issue an instruction for performing the adjustment operation as desired. Then, the processing advances to step S1411.

In step S1411, the control unit 205 determines whether the adjustment operation to be performed has been selected.

If it is determined in step S1411 that the user has not selected the adjustment operation to be performed (NO in step S1411), that is, if the user has pressed a cancel key illustrated in FIG. 15 or FIG. 16 to cancel the selection for the adjustment operation to be performed, then the processing advances to step S1406. On the other hand, if it is determined in step S1411 that the adjustment operation to be performed has been selected by the user (YES in step S1411), then the processing advances to step S1412.

In step S1412, the control unit 205 performs the adjustment operation selected by the user via the adjustment operation selection screen 2400 illustrated in FIG. 15 or FIG. 16.

In step S1413, the control unit 205 updates the information about the adjustment operation listed in the information table illustrated in FIG. 13. For example, the control unit 205 updates the time of last performance of the adjustment operation, among the information held in the information table (FIG. 13), to the current time.

Furthermore, in this case, the control unit 205 adds a predetermined time to the time of last performance and sets the time for performing a next periodical operation again. Furthermore, the control unit 205 resets the value for the "number of remaining prints before adjustment operation" field (sets the value "800" in the "number of remaining prints before adjustment operation" field) (FIG. 13).

As described above, the control unit 205 performs the adjustment operation while the print processing is interrupted due to the occurrence of the print interruption factor. Thus, the control unit 205 can delay the timing for performing the adjustment operation for the next time after the print interruption factor is solved. Then, the processing returns to step S1407.

According to the present embodiment, the control unit 205 can perform the adjustment operation in the above-described manner while the print processing for a print job has been interrupted due to the print interruption factor occurring in the printing system 1000.

That is, for example, the control unit 205 displays the adjustment operation selection screen 2400 illustrated in FIG. 15 or FIG. 16 on the operation unit 204 when the print interruption factor occurs in the printing system 1000. Then the control unit 205 performs the adjustment operation selected by the user as described above. Accordingly, the user can instruct the control unit 205 to perform the desired adjustment operation when the print interruption factor occurs.

In addition, the control unit 205 performs the adjustment operation while the processing for the print job is interrupted due to the occurrence of the print interruption factor. Thus, the control unit 205 can update the information about the timing for performing the adjustment operation for the next time and delay the timing for performing a next adjustment operation.

Accordingly, the frequency of interruption of print processing can be prevented from occurring, which case may occur when the control unit 205 performs an adjustment operation immediately after the print interruption factor, such as "no paper", has been solved by the replenishment of sheets. Thus, the present embodiment can save the user from feeling uncomfortable in waiting the printing to be resumed. In addition, the present embodiment can avoid the degradation of the productivity of the print system occurring due to an elongated print interruption.

Note that it is also useful, in the case where a plurality of adjustment operations has been set by the user to be performed at the same time when a print interruption factor occurs, if the control unit 205 determines whether the plurality of adjustment operations can be performed in parallel and performs the adjustment operations designated by the user at the same time if it is determined to perform them at the same time.

In this case, for example, it is also useful if the control unit 205 receives a selection of a plurality of adjustment operations via the screen illustrated in FIG. 15 or FIG. 16 and determines whether the received adjustment operations can be performed at the same time. If it is determined that the designated adjustment operations can be performed at the same time, the control unit 205 performs the adjustment operations at the same time.

Accordingly, the present embodiment can more effectively perform the adjustment operation because a plurality of adjustment operations can be performed simultaneously.

Second Embodiment

A second embodiment of the present invention will now be described below. In the above-described first embodiment, the control unit 205 performs the adjustment operation that has been selected by the user from among the adjustment operations previously set by the user to be performed when the print interruption factor, which has been previously set by the user, occurs.

In the second embodiment of the present invention, the control unit 205 automatically performs the adjustment operation by identifying the adjustment operation to be performed, among the adjustment operations that has been previously set by the user to be performed, without requiring a user operation for designating the adjustment operation to be performed when the print interruption factor occurs.

Figure 17:
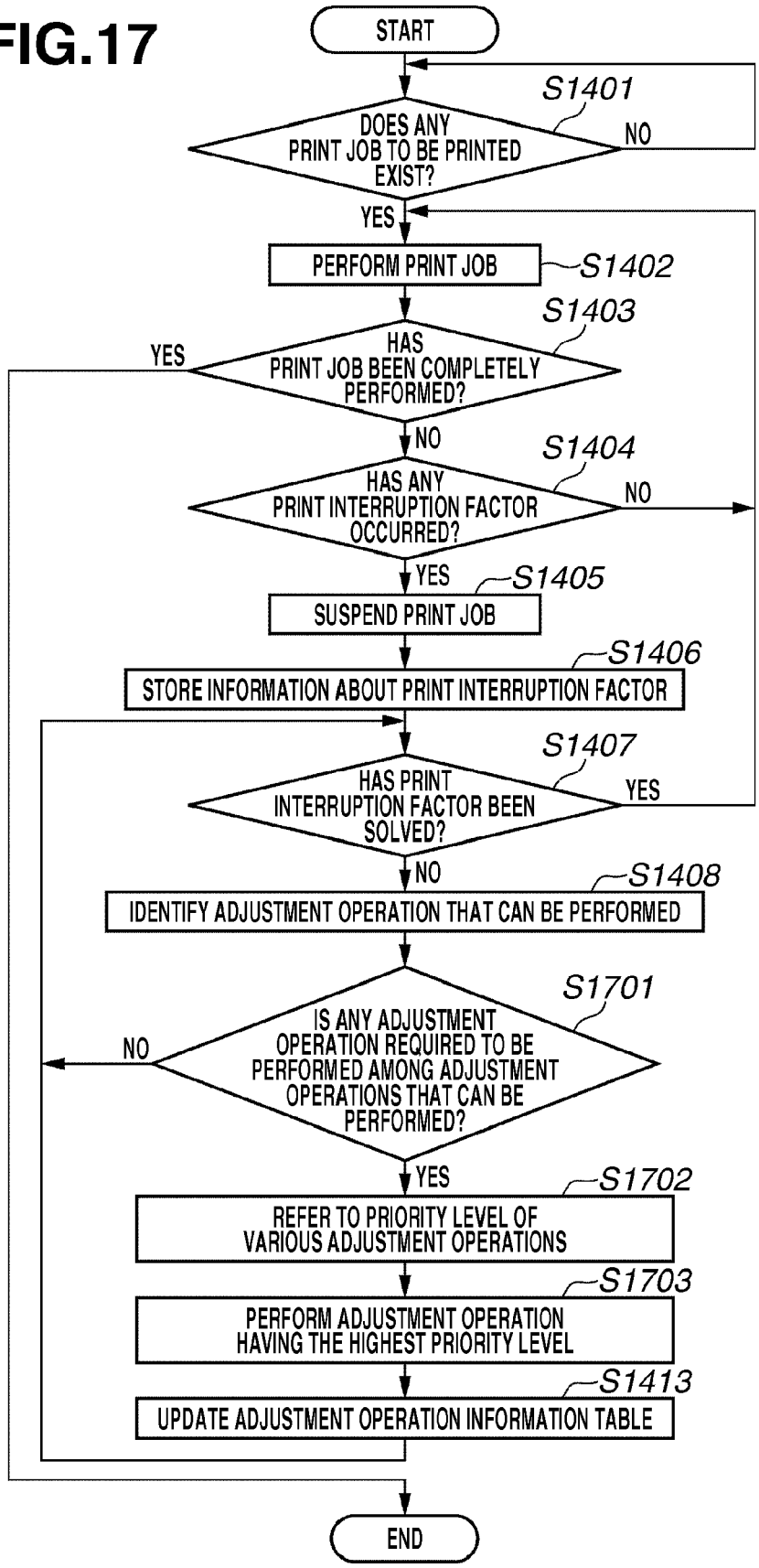
FIG. 17 is a flow chart that illustrates an example of control processing according to an embodiment of the present invention.

FIG. 17 is a flow chart that illustrates an example of control according to the present embodiment.

Note here that processing performed in the control that is similar to the processing described in the flow chart of FIG. 14 in the first embodiment is provided with the same reference symbol and number. Accordingly, the description thereof will not be repeated here. It is to be also noted here that in the present embodiment, when the user presses the OK key 2105 in a state where the setting has been set by the user as illustrated in FIG. 11, the control unit 205 generates the correspondence table (FIG. 12) and stores the generated correspondence table on the HDD 209.

When the control unit 205 identifies the adjustment operation that can be performed by referring to the correspondence table illustrated in FIG. 12 when the print interruption factor occurs in step S1408, then the processing advances to step S1701.

In step S1701, the control unit 205 determines whether an adjustment operation to be performed, among the adjustment operations that can be performed, which have been identified by referring to the correspondence table illustrated in FIG. 12, exists. Now, a method performed by the control unit 205 for determining the adjustment operation to be performed will be described below with reference to an information table illustrated in FIG. 18.

FIG. 18 illustrates an example of an information table for managing information about each adjustment operation, such as the history of performing the adjustment operation, the timing of performing a next adjustment operation, or the estimated time required for the adjustment operation, which is similar to the information table (FIG. 13) according to the first embodiment. The information table is stored on the HDD 209 by the control unit 205.

For example, the control unit 205 records the time at which each adjustment operation has been performed in a "time of last performance" field. Furthermore, the control unit 205 determines the time for performing the operation for the next time based on the time of last performance with respect to each adjustment operation and records the determined time for performing the operation for the next time in the "time for performing next periodical operation" field.

For example, suppose that it has been set by the user to perform a density adjustment operation fifteen minutes after the last adjustment operation. In this case, the control unit 205 adds fifteen minutes to the "time of last performance", at which the density adjustment operation has been performed last, and sets the resulting time as the "next periodical performance time".

Furthermore, in the "shortest time interval for performing operation" field, the time period in which the adjustment operation is not required to perform since the time of last performance is set for each adjustment operation.

When the print interruption factor occurs, the control unit 205 determines whether the time recorded in the "shortest time interval for performing operation" field has elapsed since the time of last performance and recognizes the adjustment operation whose shortest time interval for performing operation has elapsed as the adjustment operation to be performed.

On the other hand, the control unit 205 does not recognize the adjustment operation whose shortest time interval for performing operation recorded in the "shortest time interval for performing operation" field has not elapsed as the adjustment operation to be performed. Thus, the present embodiment can decrease the number of adjustment operations by not performing an unnecessary adjustment operation. Here, it is also useful if a time shorter than the value for the time described in the "shortest time interval for performing operation" field illustrated in FIG. 18 is set.

That is, if a time shorter than the value for the time described in the "shortest time interval for performing operation" field illustrated in FIG. 18 is set, then it can be prevented to perform an unnecessary adjustment operation, which may otherwise be performed again immediately after the last adjustment operation has been performed when a print interruption factor occurs immediately after performing the last adjustment operation.

In an "estimated time required" field in the table illustrated in FIG. 18, a time required for the control unit 205 to perform each adjustment operation is set. A "priority level" field includes a value used in determining an adjustment operation to be performed when a print interruption factor occurs. In this regard, the priority level becomes higher if the numerical value for the priority level becomes larger.

The control unit 205 recognizes the adjustment operation to be performed with reference to the information table illustrated in FIG. 18.

The control unit 205 refers to the current time that has been acquired from a timer (not illustrated) and recognizes the adjustment operation whose shortest time interval for performing the operation recorded in the "shortest time interval for performing operation" field has elapsed since the time of last performance thereof, of the adjustment operations listed in the information table illustrated in FIG. 18, as the adjustment operation to be performed.

If it is determined in step S1701 (FIG. 17) that the adjustment operation to be performed exists (YES in step S1701), then the processing advances to step S1702. On the other hand, if it is determined in step S1701 that no adjustment operation to be performed exists (NO in step S1701), then the processing returns to step S1407.

Here, the method for determining the adjustment operation to be performed is not limited to this. That is, it is also useful if the control unit 205 acquires the current time from the timer (not illustrated) and recognizes the adjustment operation whose time period from the current time to the time for performing the next periodical operation is shorter than a predetermined time (five minutes, for example) as the adjustment operation to be performed.

That is, in this case, the control unit 205 performs the adjustment operation whose time period from the current time to the time for performing the next periodical operation is shorter than a predetermined time after the occurrence of the print interruption factor and before resuming the processing for the print job.

Accordingly, it can be effectively prevented that an adjustment operation whose time for performing the next periodical operation has come is started immediately after the print interruption factor has been solved and thus the start of the print processing may be delayed.

If it is determined in step S1701 that an adjustment operation to be performed among the adjustment operations that can be performed exists (YES in step S1701), then the processing advances to step S1702. In step S1702, the control unit 205 refers to the priority level for the adjustment operation to be performed held in the information table illustrated in FIG. 18. Then, the processing advances to step S1703.

In step S1703, the control unit 205 serially performs the adjustment operations from the adjustment operation having the highest priority level among the adjustment operations to be performed. Then, the processing advances to step S1413.

In step S1413, the control unit 205 updates the information held in the information table.

Here, for example, the control unit 205 updates the time of last performance of the adjustment operation that has been performed, among the information held in the information table illustrated in FIG. 18, to the current time.

Furthermore, in this case, the control unit 205 adds a predetermined time to the time of last performance and sets the time for performing a next periodical operation again.

Furthermore, the control unit 205 resets the value for the "number of remaining prints before adjustment operation" field (sets a predetermined value "800" (800 copies)).

As described above, according to the present embodiment, the control unit 205 can perform the adjustment operation when the print interruption factor occurs in the printing system 1000.

In addition, according to the present embodiment, the control unit 205 can delay the timing for performing the adjustment operation for the next time after the print interruption factor has been solved by performing the adjustment operation while the print processing is interrupted due to the occurrence of the print interruption factor.

Furthermore, according to the present embodiment, it can be prevented that the resumption of the print processing is delayed in the case where the adjustment operation is started immediately after the print interruption factor, such as "no paper", has been solved by replenishing sheets in the paper feed unit and thus the period in which the print processing is interrupted is elongated.

As described above, the present embodiment can reduce the frequency of printing interruption. Thus, the present embodiment can prevent the user from feeling uncomfortable in waiting the print processing to be resumed. In addition, the present embodiment can achieve a printing system having a high productivity.

Furthermore, the control unit 205 can automatically perform the adjustment operation by identifying the adjustment operation to be performed, among the adjustment operations that have been set by the user to be performed, without requiring a user operation when the print interruption factor occurs.

Accordingly, the present embodiment can effectively perform the adjustment operation by automatically performing the adjustment operation having a high priority level without requiring a user operation when the print interruption factor occurs.

Note that it is also useful, in the case where a plurality of adjustment operations has been set by the user to be performed at the same time when a print interruption factor occurs, if the control unit 205 determines whether the plurality of adjustment operations can be performed in parallel and performs the adjustment operations designated by the user at the same time if it is determined to perform them at the same time.

Accordingly, the present embodiment can perform a plurality of adjustment operations simultaneously. Thus, the present embodiment can effectively perform the adjustment operation.

Third Embodiment

A third embodiment of the present invention will now be described below. In the second embodiment, the control unit 205 performs the adjustment operation that has been recognized as the adjustment operation to be performed, among the plurality of adjustment operations that have been set by the user to be performed for the print processing, according to the predetermined priority level.

In the control according to the third embodiment of the present invention, the control unit 205 determines the adjustment operation to be performed according to information about a job subsequent to the job whose print processing has been interrupted when the print interruption factor occurs. It is to be noted here that the portions of the system configuration and the basic processing of the present embodiment that are similar to those in the first and the second embodiments are provided with the same reference numerals and symbols, and thus the detailed description thereof will not be repeated here.

Here, for example, the PC 103 receives a print setting from the user. The control unit of the PC 103 associates the print setting information generated based on the received print setting with the print data and then sends the print data together with the print setting information as one job to the printing system 1000. Here, suppose that the PC 103 has received an instruction from the user for performing a job A, a job B, and a job C and sent the jobs A, B, and C to the printing system 1000.

In this case, the printing system 1000 receives the job A, the job B and the job C and stores the received jobs A, B, and C on the HDD 209.

Figure 19:
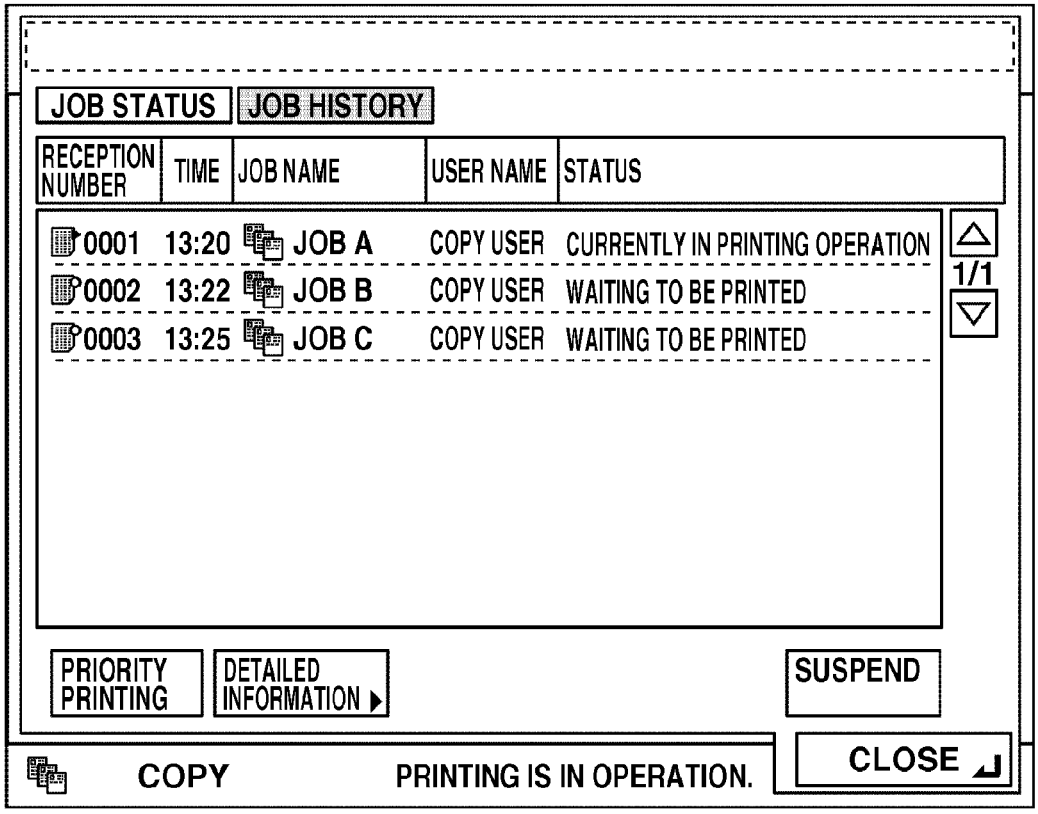
FIG. 19 illustrates an example of a screen displayed on the operation unit according to an embodiment of the present invention.

Then, if no other print job is currently performed, the control unit 205 of the printing system 1000 starts the processing for the job A. FIG. 19 illustrates an example of a job status display screen to be displayed on the touch panel unit 401 of the operation unit 204 in this case.

Here, the print processing for the job A is currently being performed. Accordingly, the control unit 205 displays information "currently in printing operation" in a status field for the job A.

The job B and the job C are waiting for their print processing to be performed. Accordingly, the control unit 205 displays information "waiting to be printed" in the status field for each of the jobs B and C.

Suppose here that in this state, the print interruption factor "no paper" has occurred with respect to the paper cassette that is a paper feeding source for the job A in the printing apparatus 100.

Figure 20:
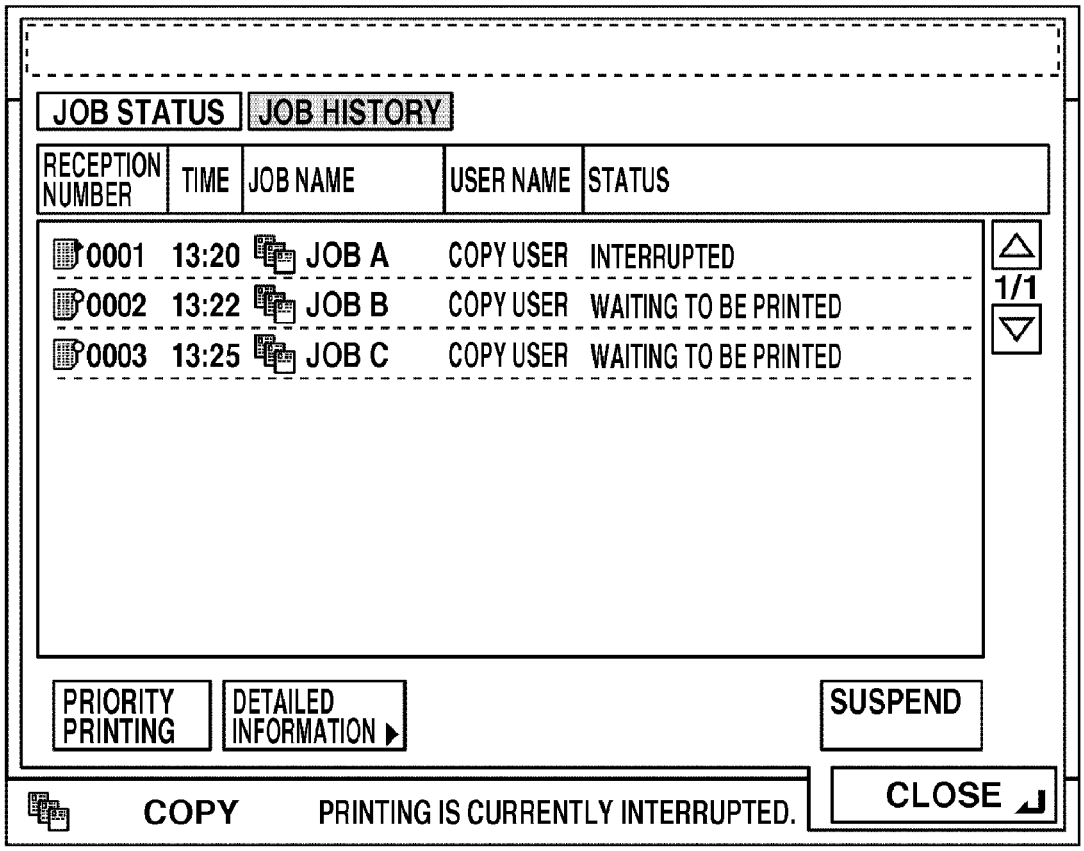
FIG. 20 illustrates an example of a screen displayed on the operation unit according to an embodiment of the present invention.

In this case, the control unit 205 stores, on the RAM 208, information indicating that the print interruption factor "no paper" has occurred and suspends the job A. Then, the control unit 205 displays a job status display screen illustrated in FIG. 20 on the touch panel unit 401.

Furthermore, the control unit 205 identifies the adjustment operation to be performed when the print interruption factor occurs. In this case, the control unit 205 determines the adjustment operation to be performed in the printing system 1000 according to information about the job B, which is subsequent to the job A.

For example, the control unit 205 determines whether the job B has been designated by the user as a job for which processing that requires the gluing binding processing is to be performed according to the print setting information included in the job B.

In this regard, if the control unit 205 determines that the job B is not a job for which the case binding processing has been designated by the user to be performed, then the control unit 205 performs the adjustment operation in descending order of priority level as discussed in the second embodiment.

On the other hand, if the control unit 205 determines that the job B is a job for which the case binding processing has been designated by the user to be performed, then the control unit 205 performs the "glue temperature adjustment operation", which is related to performing the job B, of the adjustment operations to be performed, in priority to other adjustment operations.

As described above, according to the present embodiment, the control unit 205 can perform the adjustment operation when the print interruption factor occurs in the printing system 1000.

In addition, according to the present embodiment, the control unit 205 can delay the timing for performing the adjustment operation for the next time after the print interruption factor has been solved by performing the adjustment operation and thus it is enabled to perform the print processing while the print processing is interrupted due to the occurrence of the print interruption factor.

Furthermore, according to the present embodiment, it can be prevented that the resumption of the print processing is delayed in the case where the adjustment operation is started immediately after the print interruption factor, such as "no paper", has been solved by replenishing sheets in the paper feed unit and thus the period in which the print processing is interrupted is elongated.

As described above, the present embodiment can reduce the frequency of printing interruption. Thus, the present embodiment can prevent the user from feeling uncomfortable in waiting the print processing to be resumed. In addition, the present embodiment can achieve a printing system having a high productivity.

In addition, according to the present embodiment, in the case where the print interruption factor has occurred and the adjustment operation exists that affects the processing for subsequent jobs, among the adjustment operations to be performed, the control unit 205 can perform the adjustment operation in priority to other adjustment operations. Accordingly, the present embodiment can smoothly perform the subsequent jobs.

Other Embodiments

In each of the embodiments described above, the control unit 205 delays the timing for performing a next adjustment operation after the last adjustment operation performed while the print processing has been interrupted in the following method.

That is, the control unit 205 adds a predetermined time to the time for performing the adjustment operation (the time of last performance) that is performed while the print processing has been interrupted due to the occurrence of the print interruption factor and records the resulting time in the "time for performing next periodical operation" field.

Accordingly, the timing for performing the adjustment operation for the next time can be delayed. However, the method for delaying the timing for performing the adjustment operation for the next time is not limited to this.

That is, for example, it is also useful if the control unit 205 stores information about the adjustment operation that has been performed while the print processing has been interrupted due to the occurrence of the print interruption factor and performs control so that the adjustment operation whose information is stored is not to be performed even if the time for performing the next periodical operation comes.

Accordingly, the control unit 205 can skip performing the adjustment operation once. Note that in this case, it is also useful if the control unit 205 adds a predetermined time to the time for performing the next periodical operation and sets the resulting time as a new value for the time for performing the adjustment operation after skipping it once.

In this case, the present embodiment can prevent a case from occurring where the control unit 205 starts the adjustment operation immediately after the print interruption factor, such as "no paper", has been solved by replenishing sheets and thus the period in which the print processing is interrupted is elongated, and thus, the resumption of the print processing is delayed.

As described above, the present embodiment can reduce the frequency of printing interruption. Thus, the present embodiment can prevent the user from feeling uncomfortable in waiting the print processing to be resumed. In addition, the present embodiment can achieve a printing system having a high productivity.

In each of the above-described embodiments, when the print interruption factor, such as "no paper", "full-stack on tray", or "cassette-open", occurs, the control unit 205 can perform the adjustment operation, such as the "density adjustment operation" or the "gradation correction operation". However, it is also useful if the control unit 205 can perform control so that the "density adjustment operation" and the "gradation correction operation" are not to be performed when the print interruption factor such as "paper jamming" occurs.

This is because the adjustment operation such as the "density adjustment operation" or the "gradation correction operation", which is performed on the printing apparatus 100 by generating a patch on the photosensitive drum 304 and rotating the photosensitive drum 304, cannot be appropriately performed when the sheet is jammed at a portion at which the sheet contacts the photosensitive drum 304.

On the other hand, the "glue temperature adjustment operation" performed by the gluing binding machine 200-3*b*, which is different from the printing apparatus 100, for example, can be performed when the print interruption factor "paper jamming" has occurred in the printing apparatus 100.

In this regard, it is also useful if the control unit 205 inhibits performing the adjustment operation that is performed on the printing apparatus 100 when the print interruption factor such as "paper jamming" has occurred in the printing apparatus 100 and allows performing the adjustment operation that is to be performed on an apparatus different from the printing apparatus 100 (the gluing binding machine 200-3*b*, for example).

Accordingly, even if the adjustment operation that can be performed when the print interruption factor has occurred is limited, the control unit 205 can perform some of the adjustment operations.

In each of the above-described embodiments, if the adjustment operation that can be performed still exists when the print interruption factor has occurred, the control unit 205 resumes the suspended print processing without performing the other adjustment operations when the restoration operation for solving the print interruption factor has been completed.

On the other hand, it is also useful if the control unit 205 performs all of the adjustment operations that have been determined to be performed before resuming the suspended print processing even if the print interruption factor has been solved.

Accordingly, the present embodiment can perform the print processing for the print job after completing all of the adjustment operations. Thus, the quality of the images printed in the print processing can be improved. Note here that the "shortest time interval for performing operation" described in the second embodiment can be applied to the first embodiment.

In the first embodiment, the control unit 205 determines whether the time recorded in the "shortest time interval for performing operation" field has elapsed since the time of last performance. If it is determined that the time recorded in the "shortest time interval for performing operation" field has elapsed since the time of last performance, then the control unit 205 recognizes the adjustment operation whose time recorded in the "shortest time interval for performing operation" field has elapsed since the time of last performance as the adjustment operation to be performed.

On the other hand, in the first embodiment, the control unit 205 does not recognize the adjustment operation whose time recorded in the shortest time interval for performing the operation has not elapsed since the time of last performance as the adjustment operation to be performed. In this case, the control unit 205 can display the adjustment operation that has been recognized as the adjustment operation to be performed on the adjustment operation selection screen 2400 illustrated in FIG. 15 so that the user can select the adjustment operation to be performed.

On the other hand, it is also useful if the control unit 205 displays the adjustment operation that has not been recognized as the adjustment operation to be performed in a gray-out state so that the user cannot select it via the adjustment operation selection screen 2400 illustrated in FIG. 15.

Accordingly, the present embodiment can prevent a case from occurring where the user selects the adjustment operation that has been performed immediately after performing the last adjustment operation within the time described in the "shortest time interval for performing operation" field to perform an unnecessary adjustment operation.

Furthermore, it is also useful if each of the functions of the embodiments of the present invention illustrated in FIG. 14 and FIG. 17 is performed on the host computer (the PC 103 or the PC 104, for example) by using the program that is installed thereto via an external apparatus. FIG. 21 illustrates an exemplary embodiment of the structure of the program according to an embodiment of the present invention. In FIG. 21, program code is structured in three blocks. A first block includes directory information. A second block includes program code corresponding to the control processing of the flowchart illustrated in FIG. 14 described above. A third block includes program code corresponding to the control processing of the flowchart illustrated in FIG. 17 described above.

Data for displaying the operation screen similar to that including each of the operation screens (the setting screens) described above in the embodiments of the present invention can be externally installed and the above-described various user interface screens can be displayed on a display unit of the host computer. The setting screen illustrated in FIG. 10 can be used as the example thereof in the present embodiment.

The present invention having the above-described configuration can be implemented by supplying information including a program from a computer-readable storage medium, such as a compact disc-read only memory (CD-ROM), a flash memory, or a floppy disk, to an output apparatus.

Furthermore, the present invention can be implemented by supplying information including the program from an external storage medium via a network.

In addition, the present invention can also be achieved by providing a system or a device with a storage medium (or a recording medium) which stores program code of software implementing the functions of the embodiments and by reading and executing the program code stored in the storage medium with a computer of the system or the device (a CPU or an micro processing unit (MPU)).

In this case, the program code itself, which is read from the storage medium, implements the functions of the embodiments mentioned above, and accordingly, the storage medium storing the program code constitutes the present invention.

Accordingly, the program can be configured in any form, such as object code, a program executed by an interpreter, and script data supplied to an operating system (OS).

As the storage medium for supplying such program code, a flexible disk, a hard disk, an optical disk, a magneto-optical disk (MO), a CD-ROM, a CD-recordable (CD-R), a CD-rewritable (CD-RW), a magnetic tape, a nonvolatile memory card, a ROM, and a digital versatile disc (DVD) (DVD-recordable (DVD-R) or DVD-rewritable (DVD-RW)), for example, can be used.

In this case, the program code itself, which is read from the storage medium, implements the function of the embodiments mentioned above, and accordingly, the storage medium storing the program code constitutes the present invention.

The above program can also be supplied by connecting to a web site on the Internet by using a browser of a client computer and by downloading the program from the web site to a storage medium such as a hard disk. In addition, the above program can also be supplied by downloading a compressed file that includes an automatic installation function from the web site to a storage medium such as a hard disk.

The functions of the above embodiments can also be implemented by dividing the program code into a plurality of files and downloading each divided file from different web sites. That is, a World Wide Web (WWW) server and a file transfer protocol (ftp) server for allowing a plurality of users to download the program file for implementing the functional processing configure the present invention.

In addition, the above program can also be supplied by distributing a storage medium, such as a CD-ROM and the like, which stores the program according to the present embodiment after an encryption thereof; by allowing the user who is qualified for a prescribed condition to download key information for decoding the encryption from the web site via the Internet; and by executing and installing in the computer the encrypted program code by using the key information.

In addition, the functions according to the embodiments described above can be implemented not only by executing the program code read by the computer, but also implemented by the processing in which an OS or the like carries out a part of or the whole of the actual processing based on an instruction given by the program code.

Further, in another aspect of the embodiment of the present invention, after the program code read from the storage medium is written in a memory provided in a function expansion board inserted in a computer or a function expansion unit connected to the computer, a CPU and the like provided in the function expansion board or the function expansion unit carries out a part of or the whole of the processing to implement the functions of the embodiments described above.

In addition, the present invention can be applied to a system including a plurality of devices and to an apparatus that includes one device. Furthermore, the present invention can be implemented by supplying a system or an apparatus with a program. In this case, by reading the storage medium that stores a program described by software that can implement the present invention with the system or the apparatus, the system or the apparatus can implement the present invention.

In the above-described embodiments of the present invention, the control unit 205 of the printing apparatus 100 primarily performs the above-described various control operations. However, the present invention is not limited to this. That is, a part of or all of the above-described various control operations can be performed by a controller of an external apparatus that is provided in the printing system 1000 separately from the printing apparatus 100.

While the present invention has been described with reference to embodiments, it is to be understood that the invention is not limited to the disclosed embodiments. The scope of the following claims is to be accorded the broadest interpretation so as to encompass all modifications, equivalent structures, and functions.

This application claims priority from Japanese Patent Application No. 2007-296848 filed Nov. 15, 2007, which is hereby incorporated by reference herein in its entirety.

What is claimed is:

1. A printing system adapted to perform an adjustment operation, the printing system comprising:

a storage unit configured to store information indicating a first timing for performing a first adjustment operation;

a control unit configured to perform the first adjustment operation based on the information indicating the first timing; and an updating unit configured to update the information indicating the first timing to information indicating a second timing for performing a second adjustment operation to be performed next after the first adjustment operation performed by the control unit, in a case where the first adjustment operation is performed by the control unit, the second timing being after the first timing, wherein the control unit is configured to perform the second adjustment operation before the second timing in a case where a print interruption occurs in the printing system and a predetermined period of time has passed after completion of the performing of the first adjustment operation, and wherein the updating unit is further configured to update the information indicating the second timing to information indicating a third timing for performing a third adjustment operation to be performed next after the second adjustment operation performed by the control unit, in a case where the second adjustment operation is performed by the control unit, the third timing being after the second timing.

2. The printing system according to claim 1, wherein the control unit is configured to display an adjustment operation that can be performed on a user interface unit in response to the print interruption occurring in the printing system, and wherein the control unit is further configured to perform the adjustment operation that can be performed based on an instruction received via the user interface unit.

3. The printing system according to claim 2, wherein the printing system is capable of performing a plurality of kinds of adjustment operations for the print job with the control unit, wherein the control unit is configured to display, on the user interface unit, candidates of adjustment operations that can be performed among the plurality of kinds of adjustment operations in response to the print interruption occurring in the printing system, and wherein the control unit is further configured to perform an adjustment operation selected by a user from among the candidates of adjustment operations displayed on the user interface unit.

4. The printing system according to claim 3, wherein the candidates of adjustment operations that can be performed, which are displayed on the user interface unit, can be previously designated by the user.

5. The printing system according to claim 3, wherein the candidates of adjustment operations that can be performed, which are displayed on the user interface unit, are determined based on a type of the print interruption.

6. The printing system according to claim 1, wherein the control unit is configured to start the second adjustment operation before the print job that has been suspended due to the occurrence of the print interruption is resumed.

7. The printing system according to claim 1, wherein the control unit is configured to determine whether to perform the second adjustment operation in response to the print interruption occurring in the printing system based on information about a print job subsequent to the print job that has been suspended due to the occurrence of the print interruption.

8. The printing system according to claim 1, wherein the printing system further comprises a printing apparatus and a post-processing apparatus capable of communicating with the printing apparatus, and wherein the control unit is configured to cause the post-processing apparatus to perform the second adjustment operation in response to the print interruption occurring in the printing apparatus.

9. The printing system according to claim 1, wherein the adjustment operation includes at least one of an adjustment operation related to print density, an adjustment operation related to gradation, and an adjustment operation related to a paper feed unit.

10. The printing system according to claim 1, wherein the print interruption includes at least one of cassette-open, no paper, and full-stack on tray.

11. The printing system according to claim 1, wherein the information indicating timing for performing the adjustment operation includes one of time information about a time for performing the adjustment operation and number-of-print-copy information about a number of print copies to be printed during the print job, and wherein the control unit is configured to perform the adjustment operation if it comes to a time corresponding to the time information stored in the storage unit or if a number of print copies corresponding to the number-of-print-copy information stored in the storage unit have been printed.

12. The printing system according to claim 1, wherein the control unit is configured to update the information indicating the timing by skipping the adjustment operation to be performed at a timing for performing a next adjustment operation.

13. A method for controlling a printing system adapted to perform an adjustment operation, the method comprising:

storing information indicating a first timing for performing a first adjustment operation in a storage unit;

performing the first adjustment operation based on the information indicating the first timing; and updating the information indicating the first timing to information indicating a second timing for performing a second adjustment operation to be performed next after the first adjustment operation, in a case where the first adjustment operation is performed, the second timing being after the first timing;

performing the second adjustment operation before the second timing in a case where a print interruption occurs in the printing system and a predetermined period of time has passed after completion of the performing of the first adjustment operation; and updating the information indicating the second timing to information indicating a third timing for performing a third adjustment operation to be performed next after the second adjustment operation, in a case where the second adjustment operation is performed, the third timing being after the second timing.

14. The method according to claim 13, further comprising:

displaying an adjustment operation that can be performed on a user interface unit in response to the print interruption occurring in the printing system; and performing the adjustment operation that can be performed based on an instruction received via the user interface unit.

15. The method according to claim 14, wherein the printing system is capable of performing a plurality of kinds of adjustment operations for the print job with the control unit, and wherein the method further comprises:

displaying, on the user interface unit, candidates of adjustment operations that can be performed among the plurality of kinds of adjustment operations in response to the print interruption occurring in the printing system; and performing an adjustment operation selected by a user from among the candidates of adjustment operations displayed on the user interface unit.

16. The method according to claim 15, wherein the candidates of adjustment operations that can be performed, which are displayed on the user interface unit, can be previously designated by the user.

17. The method according to claim 15, wherein the candidates of adjustment operations that can be performed, which are displayed on the user interface unit, are determined based on a type of the print interruption.

18. The method according to claim 13, further comprising starting the second adjustment operation before the print job that has been suspended due to the occurrence of the print interruption is resumed.

19. The method according to claim 13, further comprising determining whether to perform the second adjustment operation in response to the print interruption occurring in the printing system based on information about a print job subsequent to the print job that has been suspended due to the occurrence of the print interruption.

20. The method according to claim 13, wherein the printing system further comprises a printing apparatus and a post-processing apparatus capable of communicating with the printing apparatus, and wherein the method further comprises performing the second adjustment operation of the post-processing apparatus in response to the print interruption occurring in the printing apparatus.

21. The method according to claim 13, wherein the adjustment operation includes at least one of an adjustment operation related to print density, an adjustment operation related to gradation, and an adjustment operation related to a paper feed unit.

22. The method according to claim 13, wherein the print interruption includes at least one of cassette-open, no paper, and full-stack on tray.

23. The method according to claim 13, wherein the information indicating the timing for performing the adjustment operation includes one of time information about a time for performing the adjustment operation and number-of-print-copy information about a number of print copies to be printed during the print job, and wherein the method further comprises performing the adjustment operation if it comes to a time corresponding to the time information stored in the storage unit or if a number of print copies corresponding to the number-of-print-copy information stored in the storage unit have been printed.

24. The method according to claim 13, wherein updating the information indicating the second timing to information indicating the third timing includes skipping the adjustment operation to be performed based on the second timing.

25. A non-transitory computer-readable storage medium storing computer-executable instructions which, when executed by a computer in a printing system adapted to perform an adjustment operation, cause the computer in the printing system to perform operations comprising:

storing information indicating a first timing for performing a first adjustment operation in a storage unit;

performing the first adjustment operation based on the information indicating the first timing; and updating the information indicating the first timing to information indicating a second timing for performing a second adjustment operation to be performed next after the first adjustment operation, in a case where the first adjustment operation is performed, the second timing being after the first timing;

performing the second adjustment operation before the second timing in a case where a print interruption occurs in the printing system and a predetermined period of time has passed after completion of the performing of the first adjustment operation; and updating the information indicating the second timing to information indicating a third timing for performing a third adjustment operation to be performed next after the second adjustment operation, in a case where the second adjustment operation is performed, the third timing being after the second timing.

* * * * *